US007918622B2

(12) United States Patent
Whitford

(10) Patent No.: US 7,918,622 B2
(45) Date of Patent: Apr. 5, 2011

(54) PORTABLE PERIMETER DEFENSE SYSTEM

(76) Inventor: Peter D. Whitford, Pasadena, CA (US)

( * ) Notice: Subject to any disclaimer, the term of this patent is extended or adjusted under 35 U.S.C. 154(b) by 262 days.

(21) Appl. No.: 12/115,733

(22) Filed: May 6, 2008

(65) Prior Publication Data

US 2009/0067923 A1 Mar. 12, 2009

Related U.S. Application Data

(60) Provisional application No. 60/928,332, filed on May 8, 2007.

(51) Int. Cl.
*E01F 13/04* (2006.01)

(52) U.S. Cl. ..... 404/6; 256/13.1

(58) Field of Classification Search ..... 404/6, 10
See application file for complete search history.

(56) References Cited

U.S. PATENT DOCUMENTS

| | | | | |
|---|---|---|---|---|
| 1,449,518 | A | 3/1923 | Lawson | |
| 3,065,680 | A * | 11/1962 | Wiedman, Sr. | 188/32 |
| 4,630,395 | A | 12/1986 | Nasatka | |
| 4,854,767 | A * | 8/1989 | Sasaki | 404/6 |
| 4,998,843 | A | 3/1991 | Mothe | |
| 5,145,278 | A | 9/1992 | Lohrmann | |
| 5,228,237 | A * | 7/1993 | Nasatka | 49/49 |
| 5,356,119 | A | 10/1994 | Schock | |
| 5,549,410 | A * | 8/1996 | Beryozkin et al. | 404/6 |
| 5,997,211 | A | 12/1999 | Chou | |
| 6,296,234 | B1 | 10/2001 | DeBoer | |
| 6,679,649 | B1 | 1/2004 | Capalupo | |
| 6,702,512 | B1 | 3/2004 | Reale | |
| 6,767,158 | B1 * | 7/2004 | Consolazio et al. | 404/6 |
| 6,886,299 | B2 * | 5/2005 | Gower | 52/222 |
| 6,907,811 | B2 | 6/2005 | White | |
| 6,962,245 | B2 | 11/2005 | Ray et al. | |

(Continued)

FOREIGN PATENT DOCUMENTS

GB 158 281 2/1921

(Continued)

OTHER PUBLICATIONS

Carnahan Conference Paper, Albuquerque, New Mexico, Oct. 2004,, Presented by Nigel Buckley.

(Continued)

*Primary Examiner* — Raymond W Addie
(74) *Attorney, Agent, or Firm* — FSB FisherBroyles, LLP

(57) ABSTRACT

A portable perimeter defense system is provided that is configured for preventing unwanted intrusions by vehicles or other heavy and fast-moving vehicles into a protected area while also providing requisite ballistic resistance capabilities. The defense system includes individual modular barriers that can be readily transported to a point of use and can be secured in place without requiring heavy equipment or power sources, such as electricity. This can be readily achieved with as few as one person. The modular barriers include a front plate configured to provide exceptional ballistic protection in the direction of impact and to provide an impact surface capable of withstanding impact. When circumstances warrant a double row portable perimeter defense system, a bracing system is provided to render parallel rows of barriers cooperative to prevent aft tilting of the impacted forward barriers. The bracing system transfers an impact force against the forward barrier rearward and downward toward a base plate of the rearward barrier. A method of protecting an area with a portable perimeter defense system and method of installing a portable perimeter defense system is also provided.

67 Claims, 14 Drawing Sheets

U.S. PATENT DOCUMENTS

| | | | | |
|---|---|---|---|---|
| 7,083,357 | B2 | 8/2006 | Lamore | |
| 7,101,112 | B2 | 9/2006 | Burns et al. | |
| 7,140,802 | B2 | 11/2006 | Lamore | |
| 7,172,176 | B1 | 2/2007 | Eastland | |
| 7,264,417 | B1 | 9/2007 | Nasatka | |
| 7,320,557 | B1 | 1/2008 | Potter | |
| 7,494,112 | B2 * | 2/2009 | Fromm | 256/64 |
| 2004/0089143 | A1 * | 5/2004 | Gilon | 89/36.01 |
| 2006/0078380 | A1 | 4/2006 | Dehart | |
| 2006/0233607 | A1 | 10/2006 | Buckley et al. | |
| 2007/0272911 | A1 | 11/2007 | Fromm | |
| 2008/0223857 | A1 * | 9/2008 | Palley et al. | 220/560.01 |
| 2009/0092443 | A1 * | 4/2009 | Friedman et al. | 404/6 |

FOREIGN PATENT DOCUMENTS

| | | |
|---|---|---|
| WO | WO 2007/040626 | 4/2007 |

OTHER PUBLICATIONS

Delta Scientific Corporation, Portable Barriers:MP5000, posted on DeltaScientific.com, original date unknown.

General Dynamics Portable Vehicle Arresting Barrier, General Dynamics advertisement, original date unknown.

The Mifram Group Modular Vehicle Barrier, posted on MiframSecurity.com, original date unkown.

The Mojo Barriers, Mojo Steel Barrier, posted on MojoBarriers.com, original date unknown.

Delta Scientific Corporation, product specification for model DSC2000 Phalanx Barrier, posted on Delta Scientific Website, dated Oct. 11, 2006.

* cited by examiner

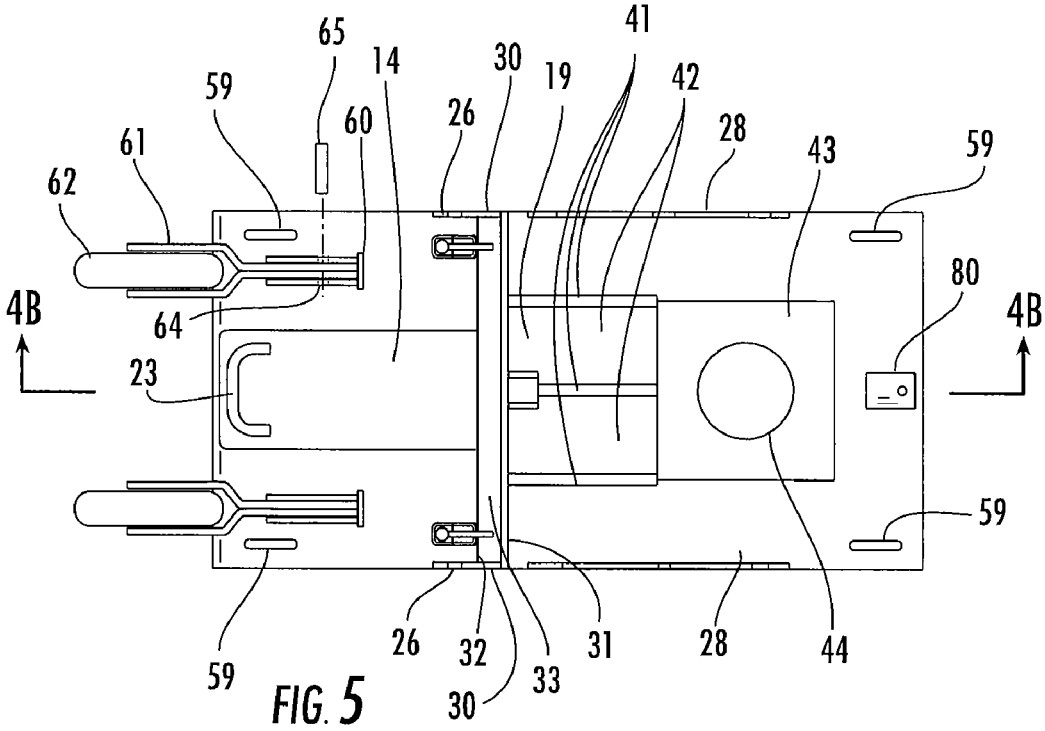
FIG. 5
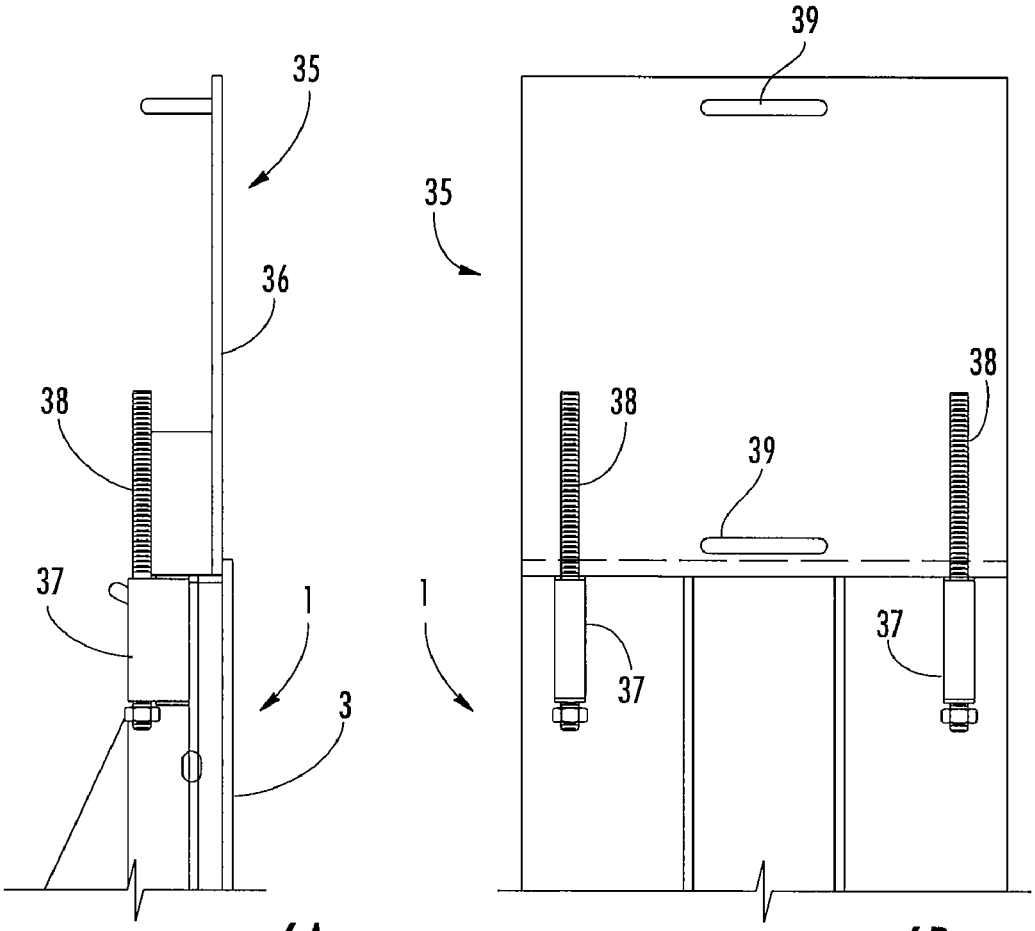
FIG. 6A
FIG. 6B

PORTABLE PERIMETER DEFENSE SYSTEM

CROSS REFERENCE TO RELATED APPLICATIONS

This application claims the benefit and priority of the U.S. Provisional Patent Application bearing Appl. No. 60/928, 332, filed May 8, 2007, which is incorporated herein by reference.

BACKGROUND OF THE INVENTION

The present invention relates to a portable perimeter defense system, a method of installing a portable perimeter defense system and a method of protecting an area for preventing unwanted intrusions by vehicles or other heavy and fast-moving objects into a protected area, and for providing protection from munitions so as to meet International Ballistic Standards.

Perimeter defense security systems that can stop unwanted intrusions by heavy, fast-moving objects into a protected space are, unfortunately, needed. For example, a heavy tonnage truck filled with explosives or assailants is an inexpensive but effective method used today by terrorists and insurgents to breach and attack a protected space, such as a military installation, embassy compound, or even domestic oil refineries. Moreover, it is also desirable that a perimeter defense system provide munitions protection for personnel, equipment, and/or facilities within the protected space, both as an everyday safeguard against stray munitions and when the barrier system is used in a tactical combat position. Conventional security systems employing conventional barriers are lacking in that they do not provide sufficient breach protection against a heavy and/or fast-moving vehicle nor do they provide sufficient protection from munitions, the impact from shrapnel or shells. In addition, prior art portable perimeter defense systems are not easily or rapidly deployable, are cumbersome to move around, and are difficult to install. Moreover, conventional security barriers do not provide alternative uses for changing conditions and/or security needs and to provide strategic deterrents by altering locations and configurations of a perimeter defense system.

For example, U.S. Patent Application Publication No. US 2007/0272911 A1 (hereinafter the '911 application) discloses a markedly different barrier system. For example, the barrier system disclosed in the '911 application requires at least four people to install each barrier. Four people are required because the heavy, individual barriers according to the '911 application must be manually lifted to be positioned. The '911 application discloses interlocked adjacent barriers forming single rows of a desired length which may then be arranged in a "split V" configuration. The amount of physical exertion required to install the barrier system according to the '911 application is excessive and time consuming, which is disadvantageous in volatile environments wherein circumstances necessitate expedited installation of a defense system or wherein changing conditions warrant movement or other reconfiguration of a defense system. The '911 application does not provide a defense system with cooperating rows of barriers for increased strength and, due to its configuration, it is not modular and not capable of numerous configurations for changing threatening conditions and/or for alterations as part of a strategic deterrent system. Moreover, the barriers according to the '911 application do not provide the level of protection from munitions afforded by the portable perimeter defense system according to the present invention.

BRIEF SUMMARY OF THE INVENTION

The present invention provides a portable perimeter defense system and methods of installing a portable perimeter defense system and for protecting an area that overcomes the shortcomings encountered with prior art systems of this type. The defense system prevents intrusion into the protected space, even from forces by fast-moving, heavy tonnage vehicles which, for example, could contain explosives or assailants. The defense system also provides munitions protection, i.e., ballistic resistance, to personnel, equipment, and/or other facilities within the protected space. The defense system provides munitions protection resulting from the unique material and configuration of the face plate including a deceleration zone enabling it to withstand 5.56 and 7.62 caliber NATO armor-piercing combat rounds, as well as .50 caliber BMG M2 ball rounds without penetrating the barrier, according to certain embodiments.

According to various embodiments, this is achieved, generally, by providing a front impact plate to the modular barrier which includes a forward panel and an aft panel with a decelerating zone there between. This zone may include munitions decelerating material such as fiberglass or Kevlar. The selected materials and unique configuration of the face plate provide munitions protection while simultaneously providing a modular barrier which can withstand extreme impact forces.

The defense system of the present invention is modular so that it can be readily transported to a point of use and can be moved into position and easily removed from position without requiring heavy equipment such as a lifter or a crane, for example. This is achieved without the need of external power sources, i.e., electricity, rendering it desirable in any environment, especially remote military or other tactical installations. The individual components of the defense system can be even positioned and installed by very few people, even just one person acting alone. As a result, it is deployable almost anywhere on short notice and is ideal for use in emergency situations. Because the defense system is modular, it can be deployed in different positions or configurations imperative for changing environments and as a strategic deterrent.

The portable perimeter defense system according to the present invention includes a first embodiment wherein individual, modular barriers are preferably anchored and provided to form a double-row defense system as described more fully below. This embodiment provides protection against the most stringent attacks such as unwanted intrusion by very heavy, fast-moving objects entering the protected space while simultaneously providing requisite munitions protection against incoming munitions and the impact of shrapnel and shells. A second embodiment of the portable perimeter defense system according to the present invention is directed to a plurality of modular barriers in a single row, positioned linearly, or in a staggered, non-linear configuration, or an individual barrier. A third embodiment of the defense system is directed to an individual modular barrier for use in different environments. A fourth embodiment of the present invention is directed a portable perimeter defense system utilizing juxtapositioned individual, modular barriers having a generally flexible attachment extending there between. The security capabilities of the four embodiments differ as to the level of protection afforded. These capabilities range from environments wherein protection from armor piercing munitions and heavy and/or fast-moving vehicles is required to environments with low threat levels, such as merely for traffic control (and munitions capabilities of "street-type" weapons).

According to the first and second embodiments of the present invention, although modular and readily movable, once installed, the defense system, by virtue of its configuration, becomes solidly positioned in place, and once in place it is a formidable barrier against any attempt to breach it. For example, test results have demonstrated that the barrier of the present invention is capable of stopping a 7½ ton total weight (15,000 lb.) truck traveling at an average rate of 30 mph in place without dislodging the barrier. In fact, test results have demonstrated that the defense system according to this invention actually resulted in negative penetration of the heavy, fast moving vehicle. Negative penetration, as used herein, means that not only did the barrier completely stop the vehicle, it actually forced the vehicle rearward without any penetration or movement of the modular barriers of the defense system.

In addition, the barrier system of the first and second embodiments of the present invention employs materials and configurations that enable it to withstand 5.56 and 7.62 caliber NATO armor-piercing combat rounds, as well as .50 caliber BMG M2 ball rounds without penetrating the barrier, so that the barrier can simultaneously be used to protect persons against such munitions. The defense system also provides blast mitigation, that is, protection from airborne articles resulting from a blast. The unique configuration of the front impact plate comprises a front plate panel and an aft plate panel defining a decelerating zone or space there between. This box-like configuration, while providing additional support, also prevents munitions penetration.

Generally speaking, the portable defense system of the first embodiment of the present invention employs at least two cooperating, modular barriers arranged behind each other (in the anticipated travel direction of a potential impact vehicle or other intrusion). The front barrier is braced against tipping over under the impact of a vehicle with one or more inclined, spaced-apart compression bars that extend from a top of the front barrier to a bottom portion of the aft barrier arranged behind it. Front portions of each modular barrier, and in particular a flat bottom plate thereof, are preferably secured to the ground with anchors that can be lowered into the ground without having to pre-drill or otherwise prepare the ground. As a result of this configuration, the portable perimeter defense system of the present invention becomes rigid and sturdy and absorbs the moment generated by the horizontal force from the impact of the vehicle some distance above the ground, for example at the height of the bumper of the vehicle, without tipping over.

More specifically, each modular barrier of the portable perimeter defense system of the present invention may be further secured to the ground by providing the barrier with a flat base plate. One or more anchors, either a concrete anchor or an earth anchor, are drilled into the ground through a hole in the base plate without the need for advance preparation of the ground. The earth anchors may be installed with an auger. The concrete anchors may be installed with a common rotary hammer and impact wrench. The anchor secures the base plate firmly in place.

A front plate is fixed to the base plate substantially perpendicular thereto. The front plate preferably offers ballistic protection in the impact direction and, according to many embodiments of the defense system, includes two parallel plates formed of different materials and separated by a deceleration zone filled with a bullet-decelerating material for protection against munitions rounds.

The modular barriers arranged behind each other are of like or similar configuration, and the aft barrier, like the front barrier, has a flat base plate secured to the ground with anchors. The barriers are cooperative in that a generally triangularly-shaped bracing system is formed between the two barriers. In this embodiment of the invention, the bracing system is defined by diagonal braces that extend from the vicinity of the top of the upright front plate to the corner between the like front plate and the base plate of the aft modular barrier. This bracing system provides multiple advantages.

For one, a rearward tilting of the upright plate of the front barrier under the horizontal force generated by an impacting vehicle is prevented, because that force is transmitted to the aft barrier, which in turn is supported by and anchored to the ground. Consequently, the impact force, even if large, cannot tilt the front barrier, resulting in an effectively rigid barrier capable of stopping the impacting vehicle in place. Additionally, the bracing system transmits a portion of the horizontal force from the front barrier to the aft barrier and thereby doubles the capacity of the barrier system against being moved relative to the ground in a generally horizontal direction under the (horizontal) force generated by the impacting vehicle. Horizontal movement, relative to the ground, is also substantially prevented, at least in part, by the arcuate configuration of a rear edge of the base plate. Together, therefore, the two cooperating barriers of the present invention form a secure and practically immovable defense system even though the system comprises barriers that are modular in construction and can be readily moved without any need for excessive lifting by personnel and/or installation equipment and, in fact, be moved by only one person.

A second embodiment of the present invention may be advantageously utilized for security installations where relatively lesser impact forces are expected. Accordingly, non-cooperating rows of modular barriers, a single row of modular barriers, or an individual modular barrier constructed in accordance with the present invention is provided. The bracing system may be provided when warranted by circumstances to provide additional strength. For security installations where even lesser degree of impact forces are expected, a third embodiment of the present invention is directed to a defense system formed of a single barrier. For security installations requiring that a path of traverse be impeded with little threat of force, a fourth embodiment of the present invention provides a gate system employing two or more modular barriers herein described.

The method of installing the portable perimeter defense system according to the present invention includes the steps of transporting the defense system comprising of a single barrier or a plurality of barriers to the general vicinity by a trailer; removing the portable defense system from the trailer; relocating the individual modular barrier or barriers to the desired position by forward moving forces, such as by moving the modular barriers or barrier utilizing wheels so as to traverse the ground to the desired location. This is achieved utilizing a hauler assembly or a tow handle assembly, alone or in combination if so preferred. Once positioned, in the embodiments utilizing more than one modular barrier, further barriers may be positioned in the desired configuration and the positioning assembly, the hauler and/or tow handle assembly, is removed. The wheel assembly is positioned into its disengaged position.

The method of installing the defense system according to the first embodiment (and optionally to the second embodiment) of the present invention includes the further steps of joining adjacent barriers along the sides of the front plate and base plates and installing anchors suitable for the ground surface. As to the first embodiment, these steps are repeated for a second row of barriers and bracing system is engaged between the front and aft rows to render the rows cooperative.

The method of installing a second embodiment of the present invention includes positioning a plurality of modular barriers in a cooperating single row (wherein adjacent barriers are joined), a non-cooperating configuration, e.g., staggered, or positioning an individual modular barrier. This method includes the optional step of positioning the bracing system so as to cooperate with the ground surface. The method of installing the third embodiment includes the aforementioned steps without utilizing a bracing system. The fourth embodiment includes the additional step of attaching a member between juxtapositioned modular barriers so as to partition a path of travel. Further aspects and advantages of the present invention are set forth below in the detailed description of the preferred embodiments.

BRIEF DESCRIPTION OF THE DRAWINGS

FIG. 5 is top plan view of the modular barrier according to the first embodiment of the present invention;

FIG. 6A is a side elevation view of a ballistic plate extension that may be optionally attached to the barrier in accordance with an embodiment of the invention;

FIG. 6B is front elevation view of the ballistic plate extension of FIG. 6A;

DETAILED DESCRIPTION OF THE INVENTION

Figure 1:
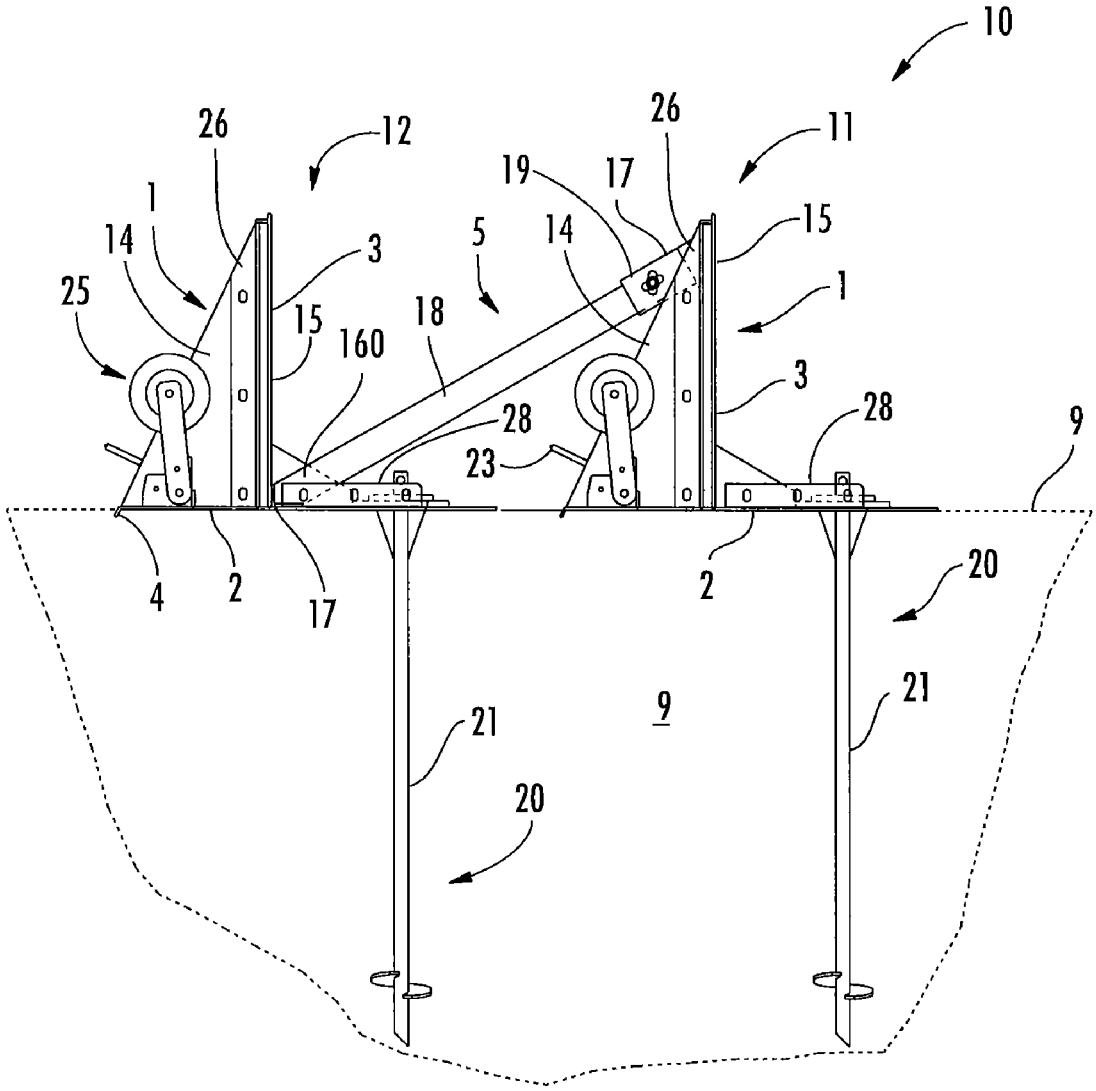
FIG. 1 is a side elevation view of a portable perimeter defense system according to the first embodiment of the present invention.
Figure 2:
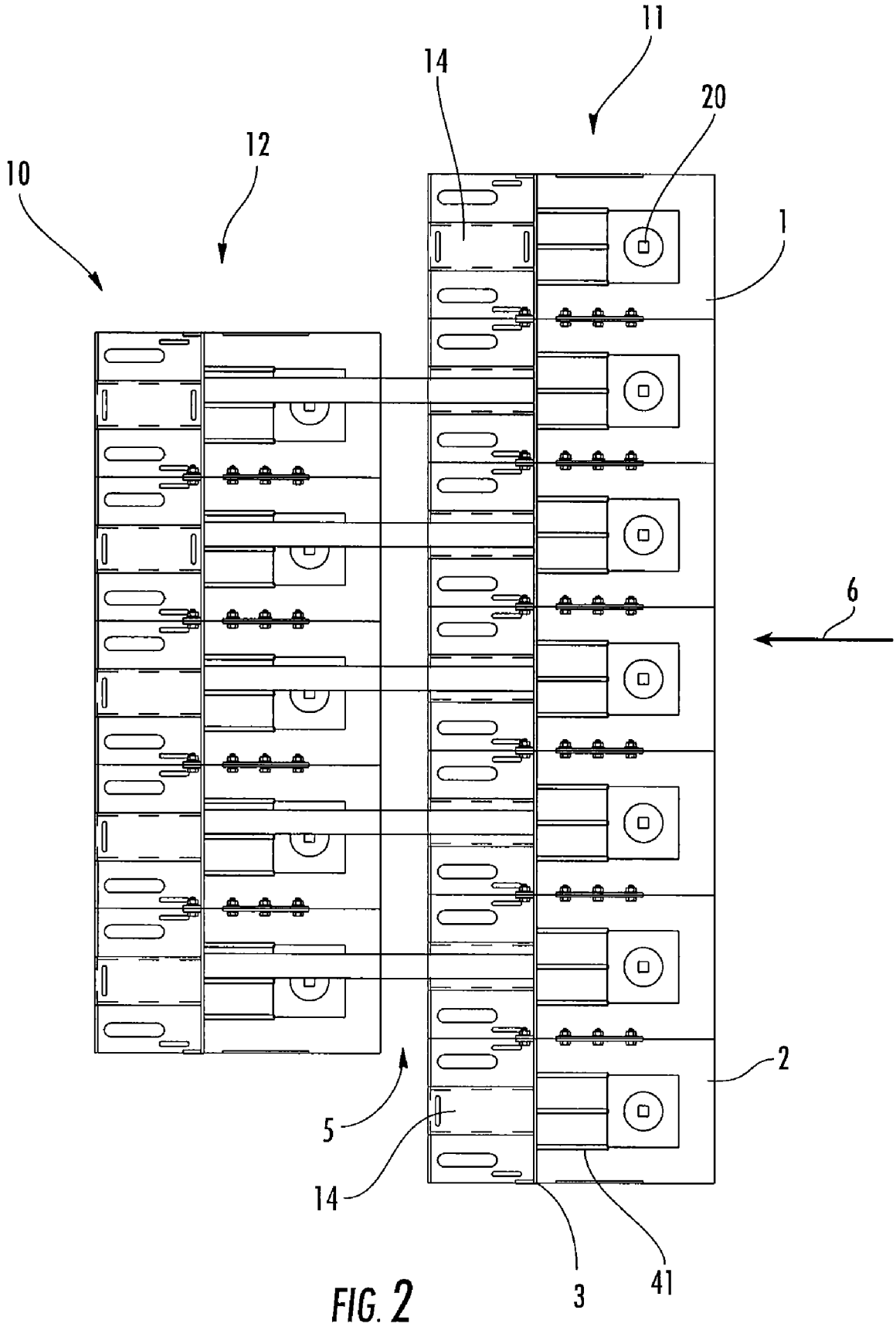
FIG. 2 is a schematically illustrated, top plan view of a preferred embodiment of the present invention which illustrates one exemplary configuration of the portable perimeter defense system of the present invention having barriers in a rear row which provide bracing for the barriers in the front row.
Figure 3:
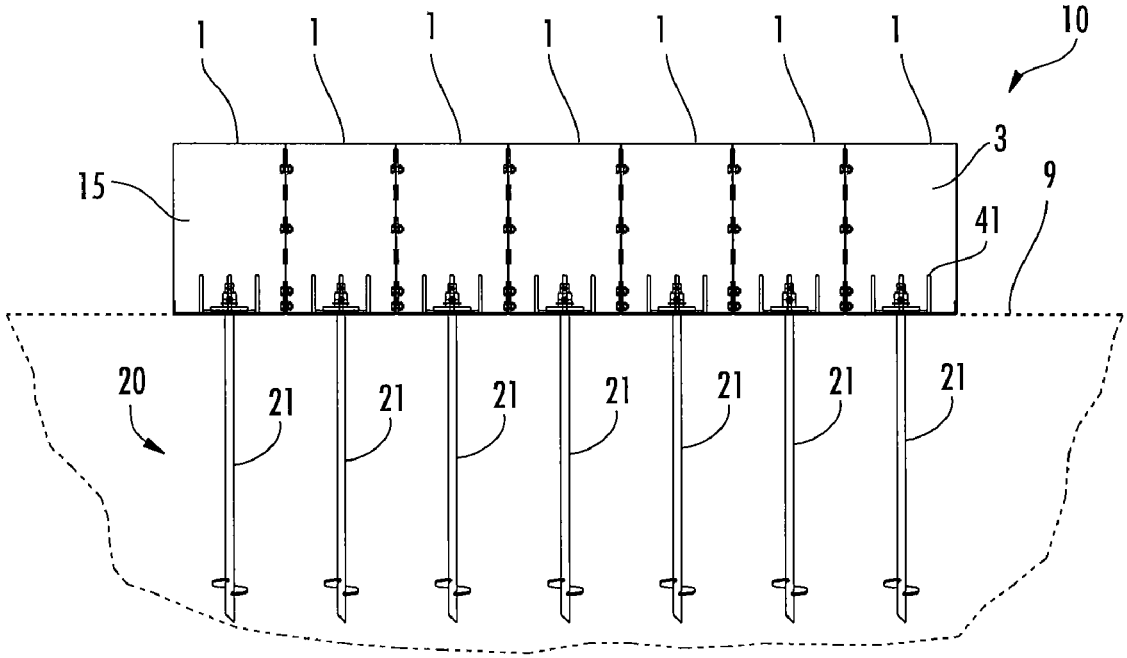
FIG. 3 is a front elevation view (in the impact direction) of the portable defense system of the present invention illustrating a number of modular barriers constructed in accordance with the first embodiment of the present invention and connected together side by side to provide the barrier system with a customizable width.

Referring to FIGS. 1, 2 and 3, a portable perimeter defense system 10 according to a first embodiment of the present invention is shown. The portable perimeter defense system 10 as shown has a customizable width and includes a front barrier row 11 and an aft barrier row 12, each comprising a plurality of individual, generally L-shaped modular barriers 1 arranged side by side and extending across the width of a roadway or other area. The barrier rows 11, 12 are generally transverse, e.g. perpendicular, to a travel direction of a vehicle and its direction of impact 6 against the defense system 10. The front 11 and aft 12 rows are parallel to each other, each individual modular barrier is anchored to the ground (as further described below), and the two rows of barriers are interconnected by a diagonal bracing system 5. The bracing system 5 supports the modular barriers 1 of the front row 11 against being tilted rearwardly by the force from an impacting vehicle that is applied against a front plate 3 and generates a rearwardly directed moment arm acting on the front barrier that has the tendency to tilt the barrier of the front row about an aft edge 4 defined by a base plate 2 of the barrier. The bracing system 5 additionally transfers a part of the horizontal impact force to the modular barriers 1 in aft row 12 to help absorb these forces and prevent potential movement of the front barrier in a horizontal direction under the force from the impacting vehicle. Rearward movement, e.g. movement traversing the ground surface, of an individual modular barrier 1 is prevented, at least in part, by the arcuate aft edge 4 of the base plate 2. While not intending to be bound by any particular theory, it is believed that the arcuate aft edge 4 provides an abutting surface which, in combination with the barrier's weight, provides sufficient frictional forces to substantially limit or prevent horizontal movement of the modular barrier 1 upon impact. While an arcuate profile of the aft edge 4 is shown, it is contemplated that the aft edge 4 may have other configurations, such as an angular profile (not shown), wherein the aft edge cooperates with the ground surface for preventing horizontal movement of the modular barrier upon impact.

Referring now more specifically to FIG. 1, which is a side elevation view of a portable perimeter defense system, two substantially identical modular barriers 1 are installed one behind the other. Each individual modular barrier 1 includes a base plate 2 that provides a ground platform for the barrier. Base plate 2 is anchored into the ground 9 (shown in phantom in FIGS. 1 and 3) beneath the barrier with anchors 20. It is within the scope of the invention, however, to not anchor the barriers or to anchor only a few of one row of modular barriers. A resistance body 14 is formed on the top of base plate 2 and is preferably triangular in shape to withstand rotational forces on the barrier 1 caused by the moment when the barrier is impacted by a vehicle in impact direction 6. Body 14 supports the front surface 15 of the front plate 3 that faces the impact direction 6. Front surface 15 preferably offers ballistic protection, as is further described below.

As shown in FIGS. 1, 7, 8 and 9, on the aft side of barrier 1 is a rear interface 17 for receiving one end of brace 18. On the front side of barrier 1 in aft row 12 is a front interface 19 that receives the other end of brace 18. Rear interface 17 is near the top of front plate 15, and front interface 19 is near the bottom of front plate 15. The aft end of brace 18 is preferably situated in and removably secured to a corner of the aft barrier defined by its upright front plate 15 and base plate 2. This forms a generally triangular shape between installed brace 18, front plate 3 and base plate 2 supported by ground 9. Further features of barrier 1 shown in FIG. 1 include handles 23 and a retractable wheel assembly 25 for enabling rapid deployment of the defense system.

Figure 4A:
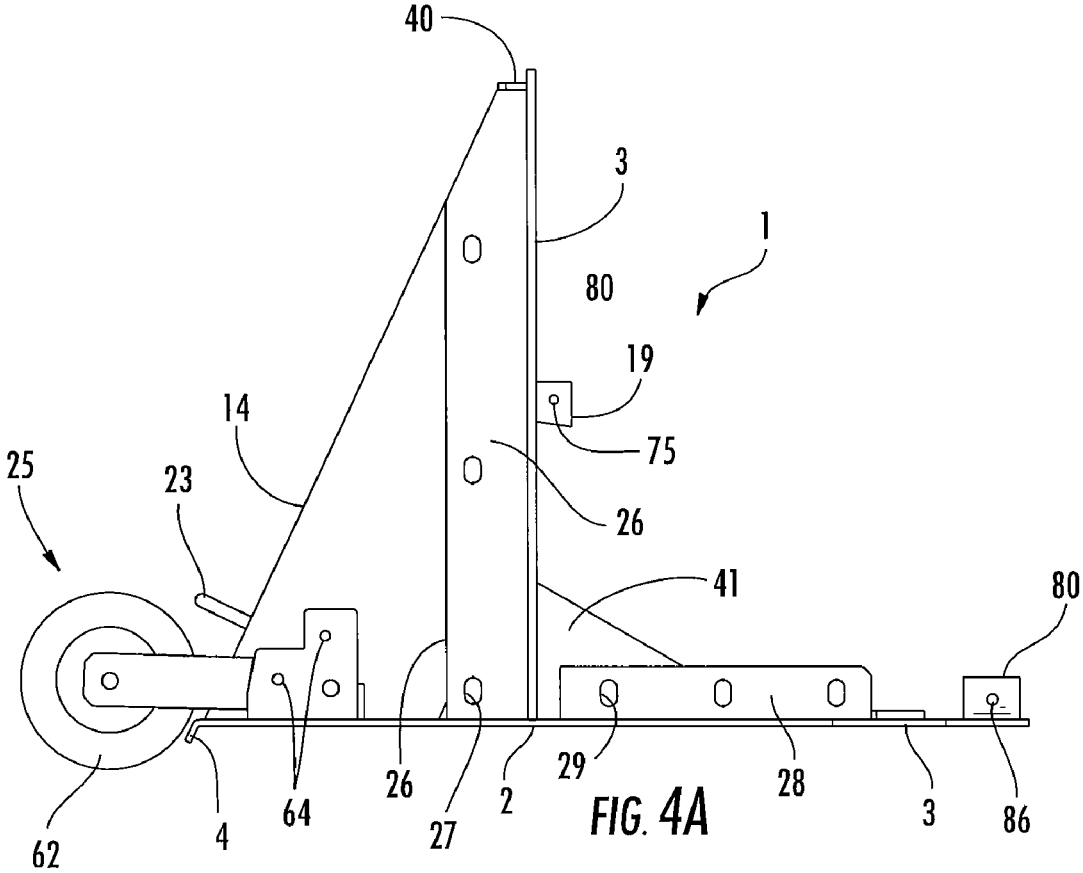
FIG. 4A is a side elevation view of a modular barrier.

FIG. 4A is a detailed elevation view of a single modular barrier 1, and FIG. 5 is a top plan view of the same. As best seen in FIG. 4A, a side plate 26 is secured, e.g. welded, to each edge of front plate 3. In the barrier system of the present invention, the L-shaped barriers are preferably of limited width, for example between 2 to 3 feet, to keep them sufficiently light for manual manipulation. Several such barriers are arranged side by side to span the width of the roadway or other ground surface over which protection is desired. In one embodiment, front plate 3 is approximately 3 feet tall and 2 feet wide. As seen in FIG. 2, side plate 26 includes bolt holes 27 that enable two barriers 1 to be disposed side by side and bolted together through holes 27. This arrangement enables barrier 1 to be installed in a modular manner to produce a single continuous barrier of a customizable width. Similarly, side plates 28, having bolt holes 29, may also be secured, e.g. welded, to the lateral edges of the base plate 2 to reinforce the side-to-side connection between adjacent barriers 1. Side plates 28 may be continuous with base plate 2 and bent upward substantially perpendicular to the base plate.

Figure 4B:
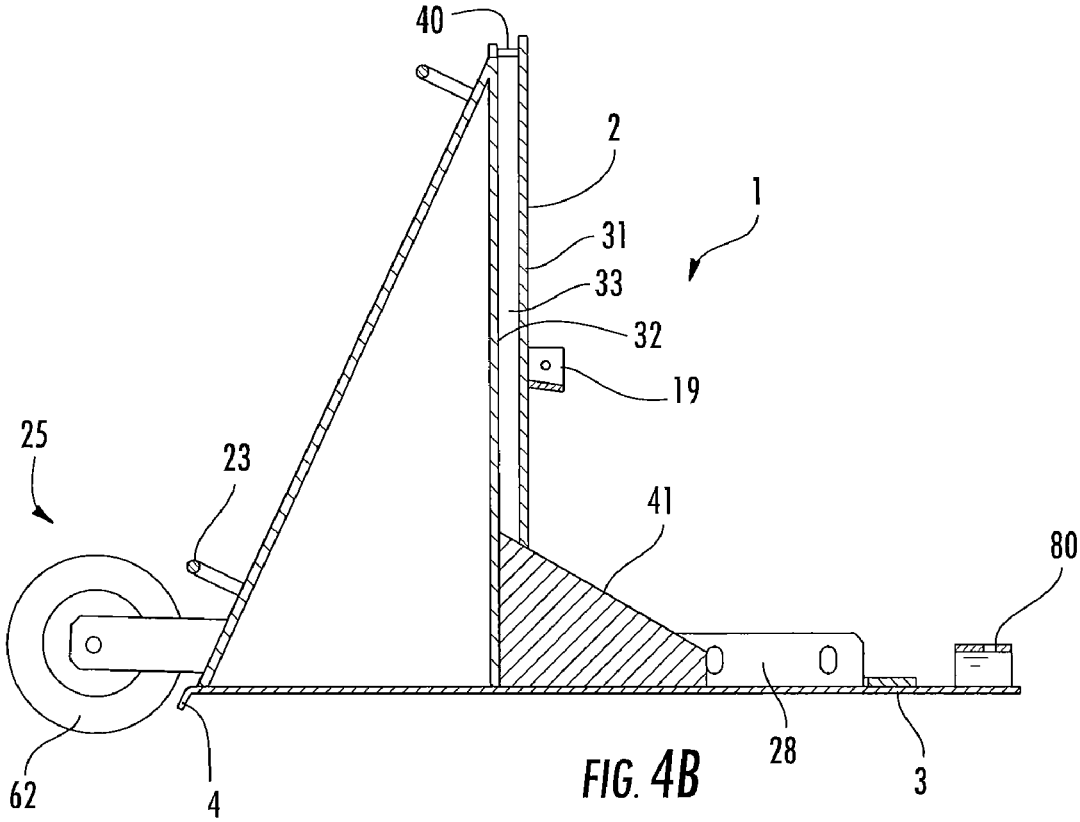
FIG. 4B is a side elevation view of the modular barrier taken along line 4B-4B shown in FIG. 5.

As seen in FIGS. 5 and 4B, body 14 is a single, fixed bracing element with a triangular cross-section (shown in FIG. 4B). In the embodiment of FIG. 5, body 14 occupies approximately the center one-third of the space behind front plate 3. Body 14 is preferably hollow, but can be solid if desired, and the width of body 14 relative to the front plate 3 may also be varied. More than one bracing element may be used to brace the aft side of front plate 3. For example, two or more bracing elements may be disposed at equal distances behind the front plate 15.

The front surface 15 of the front plate 2 preferably offers protection from munitions which exceeds all International Ballistic Standards for Small Arms for persons located behind the barrier 1. As such, front plate 2 is formed of two parallel plate panels, front panel 31 and aft panel 32, separated by an intervening deceleration zone 33. More specifically, the front panel 31 may be formed of a ballistic resistant protective material, such as armor plated steel, e.g., AR400 grade steel, and the aft panel 32 may be formed of ASTM 572 grade steel. The front panel 31 thereby is formed of a material with is rated and tested to exceed International Ballistic Standards for Small Arms while also serving as the initial impact plate to absorb the full impact of an oncoming vehicle. The aft panel 32 reinforces the overall structure of the barrier and provides back up to the front ballistic panel 31 should the front panel 31 be continuously hit with rounds that might, somehow, pierce the front panel 31. As shown in FIGS. 5, 4A and 4B, side panels 30 and top panel 40, which are preferably welded to front plate panel 31 and aft plate panel 32 so to form a box-like configuration. According to the preferred embodiment of the present invention the deceleration zone 33 is between 1 and 3 inches and, more preferably, is approximately 1½ to 2 inches wide, e.g. 1 11/16 inches (as defined between the plate panels 31 and 32). This width is greater than the length of any bullets stated in the International Ballistic Standards for Small Arms. The deceleration zone 33 may be void or optionally filled with a material that provides additional ballistic resistance, such as fiberglass or Kevlar, for example. This unique combination of materials and configurations results in a ballistic plate that withstands 5.56 and 7.62 caliber NATO armor-piercing combat rounds, as well as .50 caliber BMG M2 ball rounds without penetrating the barrier. Tests have indicated that this configuration of materials performed at or above the following ballistic standards: National Institute of Justice (NIJ) Level IV; UL-752 Underwriters Laboratory Level 8; ASTM Rifle AP. Furthermore, this unique combination of materials provides blast mitigation, that is, protection from airborne articles resulting from a nearby blast.

While not intending to be bound by a precise theory, it is believed that the modular barrier having a front impact plate 3 as described permits munitions, such as bullets, to fully penetrate and exit the front panel 31 before impacting the second, aft panel 32. The velocity of the bullet may be so great penetrating the front plate 32 that it would likewise penetrate the aft plate 32 were it not for the decelerating zone 33. The bullet completely penetrates and exits the front panel 31, thereby being suspended, and is then redirected within the deceleration zone thereby hitting the aft panel 32 at a different angle wherein the velocity of the bullet is further reduced. The box-like configuration is also beneficial with respect to the strength of the defense system 10 to prevent intrusion from vehicles. Additionally, the front surface 15 may be tilted rearward to deflect incoming projectiles upwardly and thereby enhance the ballistic resistance provided by the present invention.

FIG. 6A is a side elevation view of a ballistic plate extension 35 that can be attached to a barrier 1 for additional ballistic resistance. Plate extension 35 increases the total height of the front plate 3, for example, for ballistic protection for personnel standing behind the front plate. Extension 35 includes a ballistic protective plate 36, which is shown as a single plate but may also be formed in the double-panel configuration of front plate 3. Plate 36 is attached to a mounting 37 secured to front plate 3 with bolts 38. Plate 36 can include handle 39 to facilitate manually deploying the plate extension. FIG. 6B is a rear elevation of the installed ballistic plate extension 35 and further illustrates the releasable connection between the top of front plate 3 and the ballistic plate extension.

Figure 7:
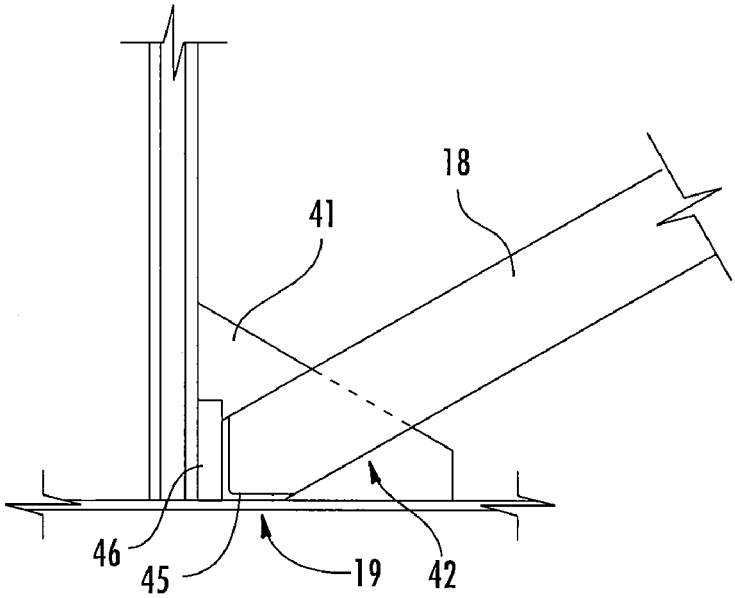
FIG. 7 is a side elevation detail showing the connection between the front brace interface and the rearward end of the brace.
Figure 9:
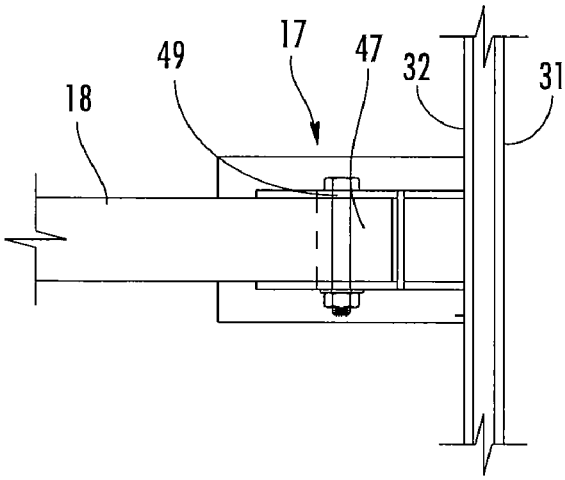
FIG. 9 is a top plan detail of the brace connection shown in FIG. 8.

FIG. 7 is a side view of the front brace interface 19 shown in FIG. 1 which is also shown in top plan view in FIG. 9. The front brace interface 19 includes a plurality spaced apart, equally spaced bracing elements 41. Preferably, three such bracing elements 41 are provided as shown in FIG. 5. These bracing elements 41 define a seat which, together with the front surface 15 of the front plate 3, defines a receiving area 42 for positioning the aft end of the brace 18. As best seen in FIG. 5, interface 19 is disposed at the center of front plate 2 and includes three equally spaced bracing elements 41 that create two receiving areas 42 between them. Bracing elements, in addition to receiving the aft end of brace 18, provide support to the front plate 3 to withstand impact forces imparted by fast-moving and heavy vehicles. As best illustrated in FIG. 7, the rearward end 45 of brace 18 is configured to as geometrically correspond with the configuration of the receiving area 42 defined by the front plate 3 and the bracing elements 41. In the preferred embodiment shown, this configuration is angular, that is, triangular to as to include a right angle to mate with the perpendicular intersection of the front plate 3 and base plate 2.

FIG. 7 is a side elevation detail showing the connection between a front brace interface 19 of a barrier 1 in aft row 12 and a rearward end 45 of diagonal brace 18. In one embodiment, end 45 of the brace is disposed in one of the receiving areas 42 of interface 19, requiring a slight lateral offset between the barrier in forward row 11 and the barrier in aft row 12 (see FIG. 2).

In another embodiment, end 45 of the brace 18 includes a cut-out (not shown) that is configured so that end 45 fits over a center bracing element 41 (shown in FIG. 7). Alternatively, interface 19 may be formed of only two elements 41 and a single, centered area 42 for receiving end 45. Shim plates 46 can be used to fill any gap that may exist between the brace and front panel 31 to facilitate the force transfer from brace 18 to the plate. In one preferred configuration, end 45 of the brace and the base plate 2 form an angle of approximately 30 degrees.

Base plate 2 also includes a hole stiffener plate 43 disposed forward of bracing elements 41. Hole stiffener plate 43 includes a hole 44 for receiving anchor 20 (shown in FIG. 1). Hole 44 is aligned with a corresponding hole 29 in base plate 2 through which anchor 20 extends.

Figure 8:
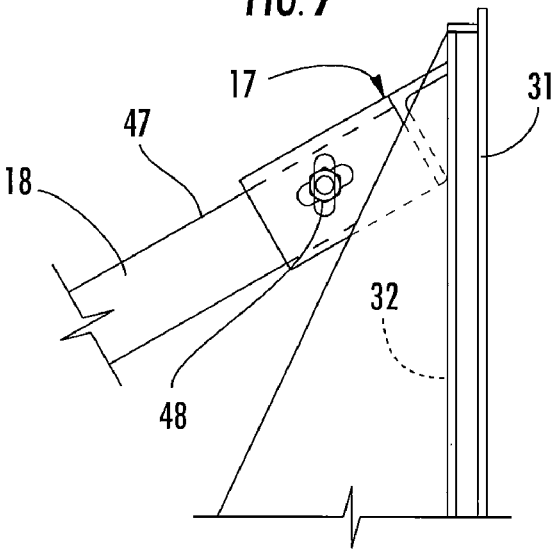
FIG. 8 is a side elevation detail of the rear brace interface showing the connection with the forward end of the brace.

FIG. 8 is a side elevation detail of rear brace interface 17 (shown in FIG. 1) to which a forward end 47 of brace 18 is connected. FIG. 9 is a top plan detail of the same brace connection. As shown in FIGS. 8 and 9, interface 17 is partially disposed within a cut-out portion of body 14 and is fixed to aft panel 32. End 47 of the brace 18 extends into interface 17. Through holes 48 of interface 17 correspond to holes 49 on end 47 of the brace. A bolt 52 passes through holes 48 and 49 to fix brace 18 to rear brace interface 17. In one preferred configuration, end 47 of the brace and panel 32 form an angle of approximately 60 degrees.

Figure 10:
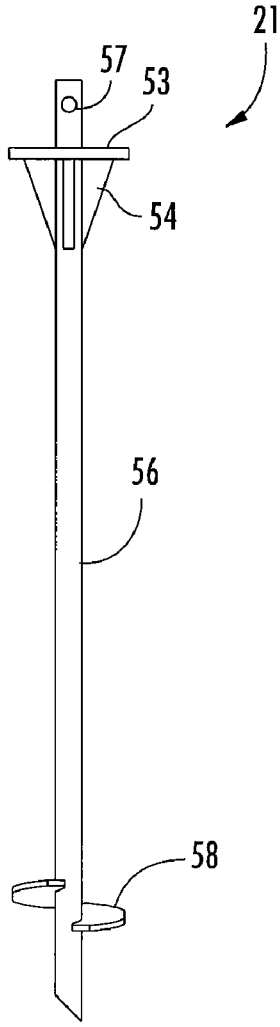
FIG. 10 is a side elevation view of the earth anchor assembly in accordance with the present invention.

FIG. 10 is a side elevation view of one form of an anchor assembly 20. As shown, the anchor assembly 20 is in the form of an earth anchor 21 for insertion into the ground. Anchor 21 includes a top plate 53 supported by fins 54 attached to a central solid steel bar 56. Fins 54 cooperate with top plate 53 to provide a secure attachment. In one embodiment, steel bar 56 is a 1.75 inch diameter hot-rolled, round-cornered-square (RCS), solid steel bar per ASTM A29 specifications, with minimum yield strength of 90 ksi and is approximately 5.0 feet long. At the top end of bar 56 is a hole 57 to engage with machinery for installing the anchor 21, e.g. a drill. At the bottom end of bar 56 is a helical augur tip 58 configured to augur into the ground when it is rotated with a drill or other machinery capable of rotating the anchor (see also FIG. 1).

In one embodiment, augur 58 is made of 0.5 inch thick hot-rolled, low-carbon steel sheet per ASTM A656 (or A1018 grade 80), with a minimum yield strength of 80 ksi, and has a sharpened leading edge. The augur tip 58 enables the anchor 21 to be installed in a single step in which the augur tip 58 is drilled down into the earth until plate 53 contacts the top of hole stiffener plate 44 (shown in FIG. 7) and thereby holds it down. Anchor 20 is then left in place to secure the modular barrier 1. This approach is advantageous compared with conventional systems and methods because the earth immediately surrounding the installed anchor 21 need not be loosened by a prior auguring step (e.g. drilling down with an augur and reversing the direction of drilling to remove the augur) and therefore strengthens the anchor so that it has a greater resistance against horizontal motion (under the horizontal impact force) and/or being lifted out of the ground (by the moment generated by the impact force).

The modular barrier 1 of the present invention also enables rapid deployment of the barrier. As shown in the top down view of FIG. 5, a number of U-shaped, bent rod handles 59 are provided at several locations on base plate 2 and front plate 3. The handles 59 are for use by personnel deploying and transporting the barrier 1.

Figure 12:
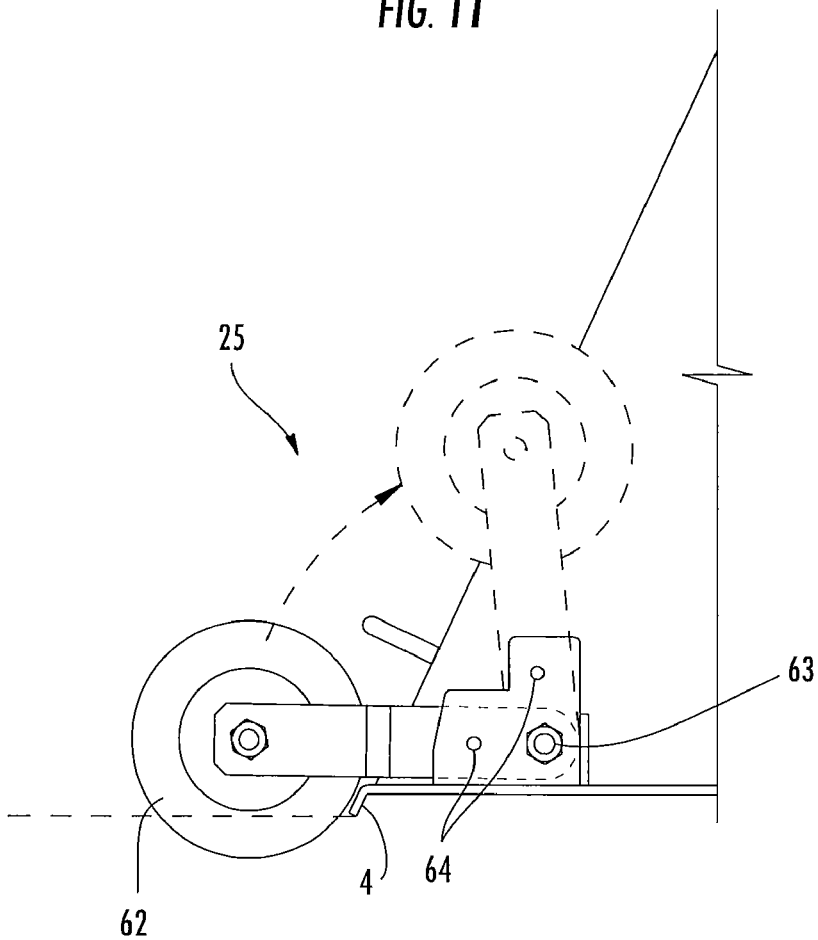
FIG. 12 is a detailed side elevation view of the wheel assembly.

FIGS. 12 and 5 illustrate a retractable wheel assembly 25 of the present invention for readily moving the barrier over road, ground and other surfaces. As best seen in FIG. 5, a wheel assembly 25 is arranged on either side of base plate 2 and provides rolling ability to the barrier 1. Each wheel assembly 25 includes a wheel attachment 60 secured to and projecting upwardly from base plate 2. A fork 61 rotatably mounts a preferably puncture-resistant wheel 62. The fork is secured to attachment 60 by a pivot 63. Pin holes 64 are provided on attachment 60 for securing the fork 61 (and wheel 62) in a deployed position and a stored (disengaged) position, respectively, using pin 65. Fork 61 with wheel 62 can be pivoted between an engaged position (for wheeling the barrier to or from an installation site) and a disengaged, retracted position (shown in phantom in FIG. 12) when the barrier is deployed.

The portable perimeter defense system 10 according to the first embodiment of the present invention includes a front row 11 and aft row 12 of modular barriers 1. To achieve desirable resistance to penetration from fast-moving, heavy objects, the preferred embodiment provides for seven modular barriers 1 in the front row 11 and five modular barriers 1 in the aft tow 12. For example, test results have demonstrated that this configuration is capable of stopping a 7½-ton total weight (15,000 lb.) truck traveling at 30 mph in place without dislodging the barriers. It is within the scope of this invention, however, that rows of varying widths may be employed to achieve the requisite resistance capabilities.

While formidable when deployed in a single row, in this preferred form, the portable perimeter defense system 10 of the present invention reinforces all barriers 1 with a second row of aft barriers that brace the forward barriers for the reasons and in the configurations described above. FIG. 2 schematically illustrates this embodiment. The configuration of FIG. 2 uses a lateral offset that shifts each of the second row barriers 12 by a distance to the left of its corresponding first row barrier 11 (as seen from impact direction 1). A similar lateral shift to the right or a centered configuration may also be used. It should be understood that the modular barrier 1 of the present invention is fully modular and may be configured in a single line, a double line, in a staggered format, or in any other desired formation enabled by its novel design.

Figure 13:
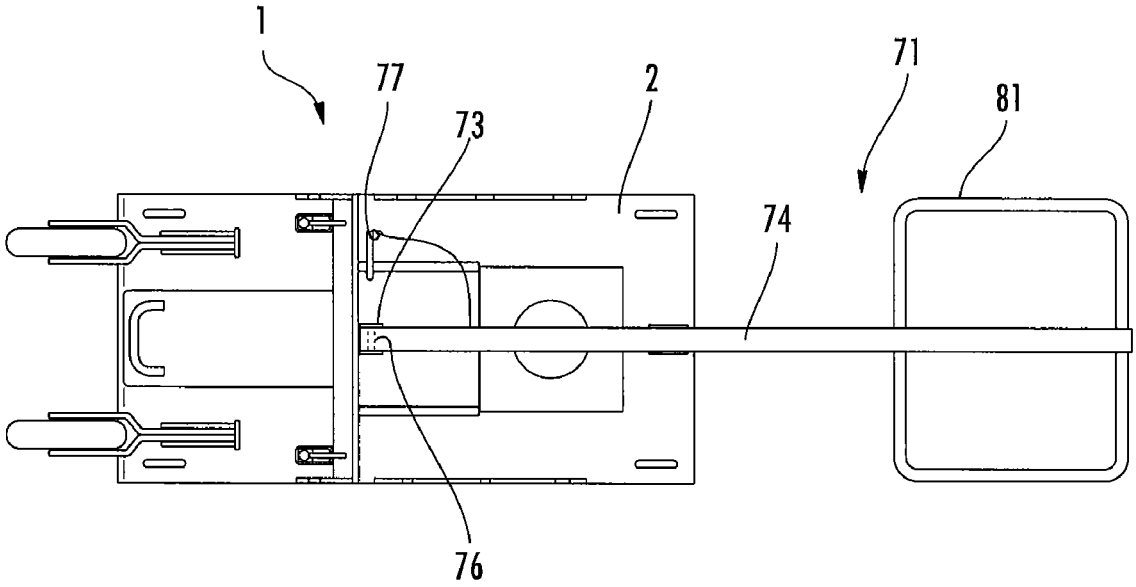
FIG. 13 is a top plan view showing a tow handle assembly of the barrier in accordance with an embodiment of the present invention.
Figure 14:
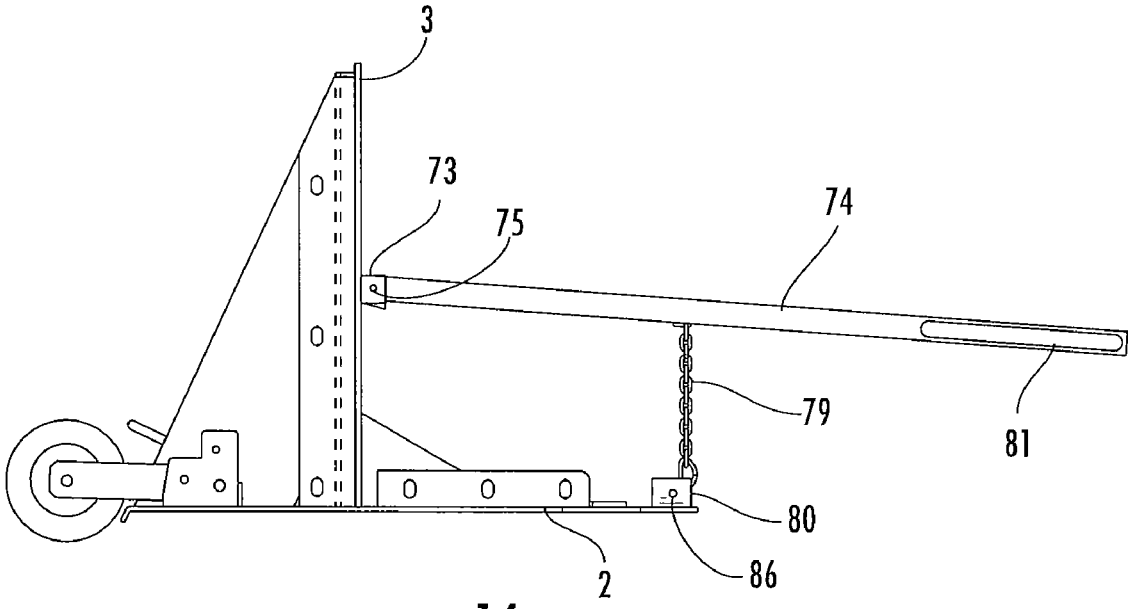
FIG. 14 is a side elevation view of the tow handle assembly shown in FIG. 12.

FIG. 14 is a side elevation view showing a transporting assembly 70 in the form of a tow handle assembly 71 of the portable perimeter defense system 10 according to the present invention. FIG. 13 is a top plan view of the tow handle assembly 71 shown in FIG. 14. The tow handle assembly 71 cooperates with tow interface 73 which projects from front plate 3 and which is configured to receive one end of tow bar 74. Tow interface 73 includes a pin hole 75 that corresponds to a pin hole 76 in the received end of the tow bar 74. A pin 77 is placed through holes 75 and 76 to secure the end of the tow bar 74 to front plate 3. A hole 78 located on a hauler interface 80 (described more fully below) extends upwardly from base plate 2 and can is engaged by the ends of chain 79. The other end of chain 79 is secured, e.g. hooked, to tow bar 74 at an intermediate point. A handle bar 81 extends from the other end of tow bar 74 so that personnel deploying the barrier 1 can lift the front end of the barrier off the ground to move the barrier 1 on wheels 62 when they are pivoted into their engaged position. Tow bar assembly 71 can also be coupled to a truck or the like to provide rapid mobility for the barrier 1 by towing it to the desired location.

Figure 16:
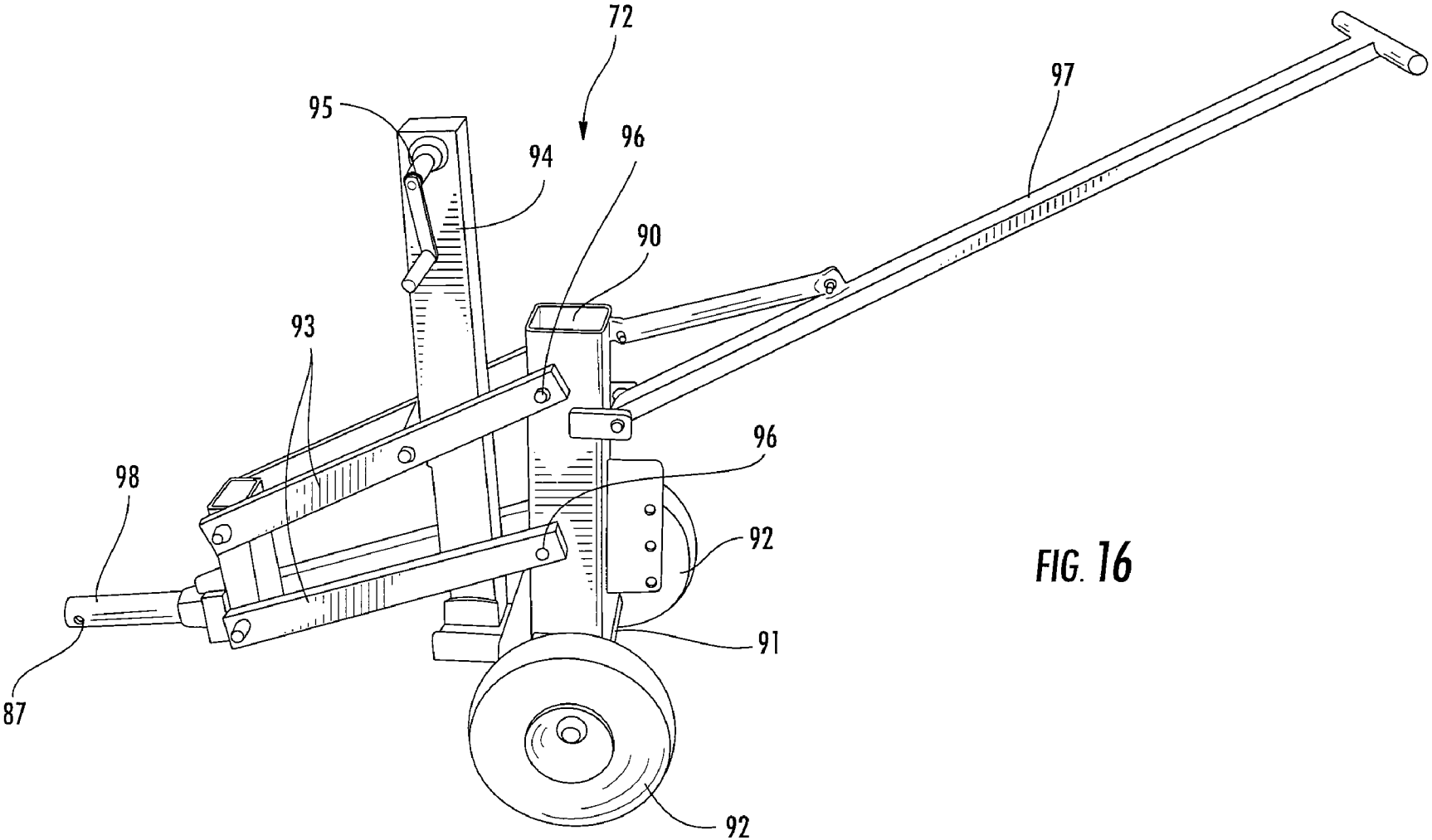
FIG. 16 is a perspective view illustrating another transporting assembly, the hauler assembly, for the modular barrier.
Figure 17:
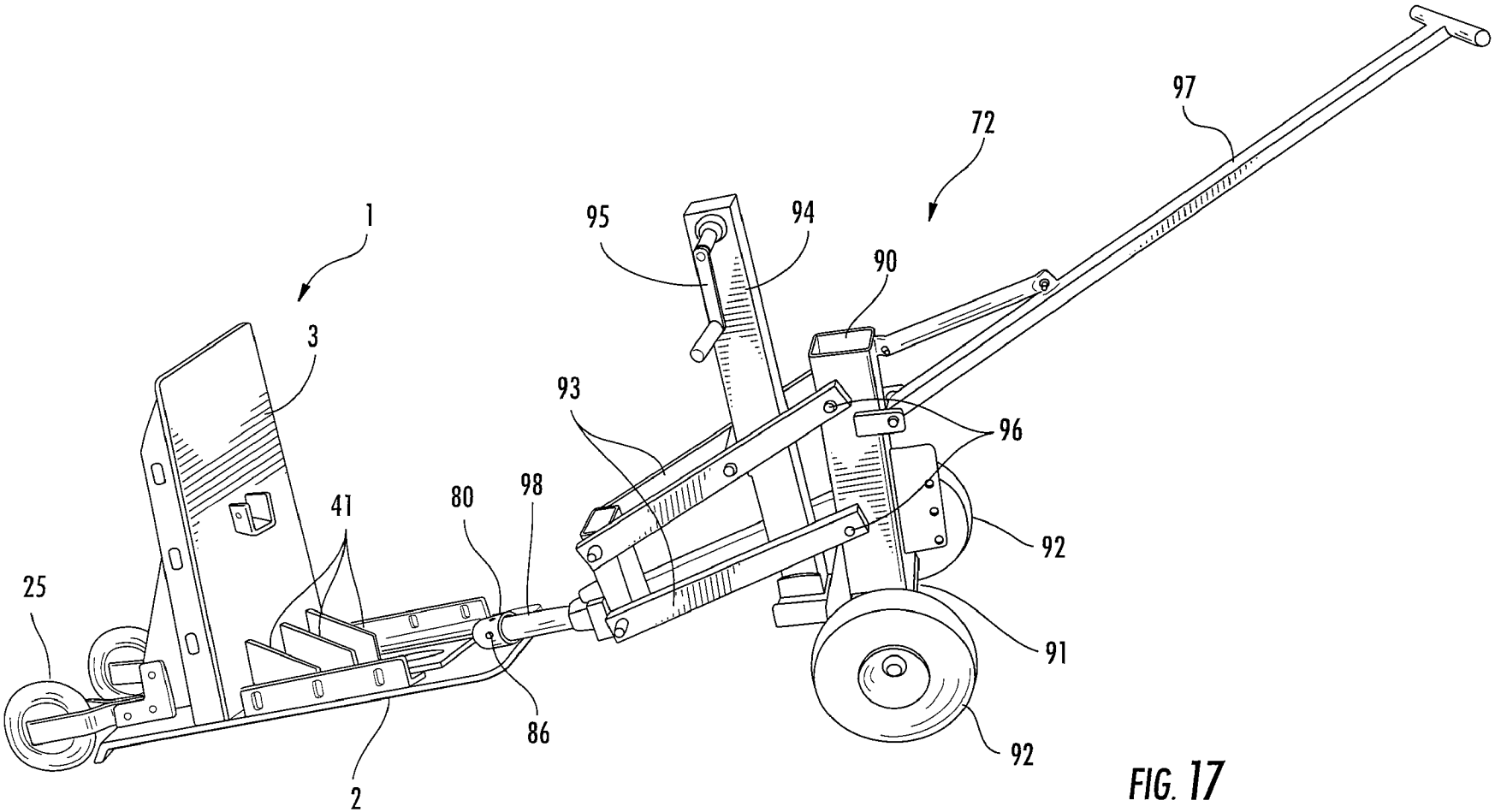
FIG. 17 is a perspective view of the transporting assembly of FIG. 15 shown cooperating with the modular barrier.

A transporting assembly 70 in the form of a hauler assembly 72, shown in FIGS. 16 and 17, may also be used to position individual modular barriers 1. Hauler assembly 72 includes frame 91 supporting a hollow column 90 and wheels 92. The frame 91 further includes generally horizontal frame members 93 extending outwardly from and being pivotally attached to column 90. Vertical member 94 is connected to the frame 91 and houses the raising mechanism to raise a mating element 98 or nose that cooperates with the modular barrier 1 to raise the front end thereof. The nose 98 of the hauler assembly is received within the hauler interface member 80. The mating element 98 includes a pinhole 87 and the hauler interface 80 includes a pinhole 86. When the two are engaged, therefore, a pin is positioned within the corresponding pinholes 86, 87 to further secure the connection of the hauler assembly 72 and the modular barrier 1 for transport. Vertical member 94 includes a hand crank 95. Accordingly, the hand crank 95 is rotated by the user and vertical member 94 serves as a jack to raise the horizontal members 93 which pivot about point 96 to raise the nose and, hence, raise the front edge of the barrier to fully engage the wheels 25 of the modular barrier for transport. The weight of the modular barrier is then supported by the wheels 62 in the engaged position. The vertical member 94 my include numerous lifting mechanism but, preferably includes a jack such as a 500 lb. capacity jack sold under the trade name Bulldog Square Tube Trailer Jack.

A second embodiment of the present invention will herein be described wherein like elements bear like numerals as those set forth with regard to the first embodiment. According to the second embodiment, the portable perimeter defense system 10 includes modular barriers 1 or a single modular barrier 1 having the above-described features of the modular barrier 1 described above regarding the first embodiment. Barriers positioned parallel to one another do not utilize the bracing system so that the parallel barriers or parallel rows of barriers do not cooperate. If the bracing system is employed to further prevent aft tilting, it cooperates with a ground surface either by resting thereon or by being secured, such as by an anchoring member, to the ground. The ground thereby is the bracing support according to this embodiment rather than a second barrier according to the first embodiment. Adjacent barriers may optionally be joined utilizing the side plates 26 and 28 as described above. This defense system may include a single barrier 1, a row of connected or unconnected modular barriers, or a non-cooperating arrangement of barriers such as a staggered configuration shown in FIG. 18. This embodiment is utilized in situations where the anticipated impact forces are lesser than in the first embodiment and, the substantially parallel aft row of modular barriers 1 can be eliminated. In such event, the bending moment generated by the force from the impacting vehicle, as well as the horizontal force itself, is absorbed by the barriers of one row or an individual barrier. Aft tilting of the barrier in such an arrangement is further prevented by optional anchors 20 extending into ground 9 and/or optional use of the bracing system 5. The entire horizontal force of the impact is absorbed by the non-cooperating barrier or barriers. This arrangement provides substantially the same protection against incoming munitions rounds as the double-row barrier system, as is described above. That is, it enables the barrier or barriers to withstand 5.56 and 7.62 caliber NATO armor-piercing combat rounds, as well as .50 caliber BMG M2 ball rounds without penetrating the barrier.

An advantageous benefit of this embodiment of the portable perimeter defense system 10 is that the individual modular barriers may be quickly and easily repositioned which is beneficial as part of a strategic deterrent plan. The modular barriers may be rearranged so as to provide a level of surprise to approaching persons or vehicles.

Figure 11:
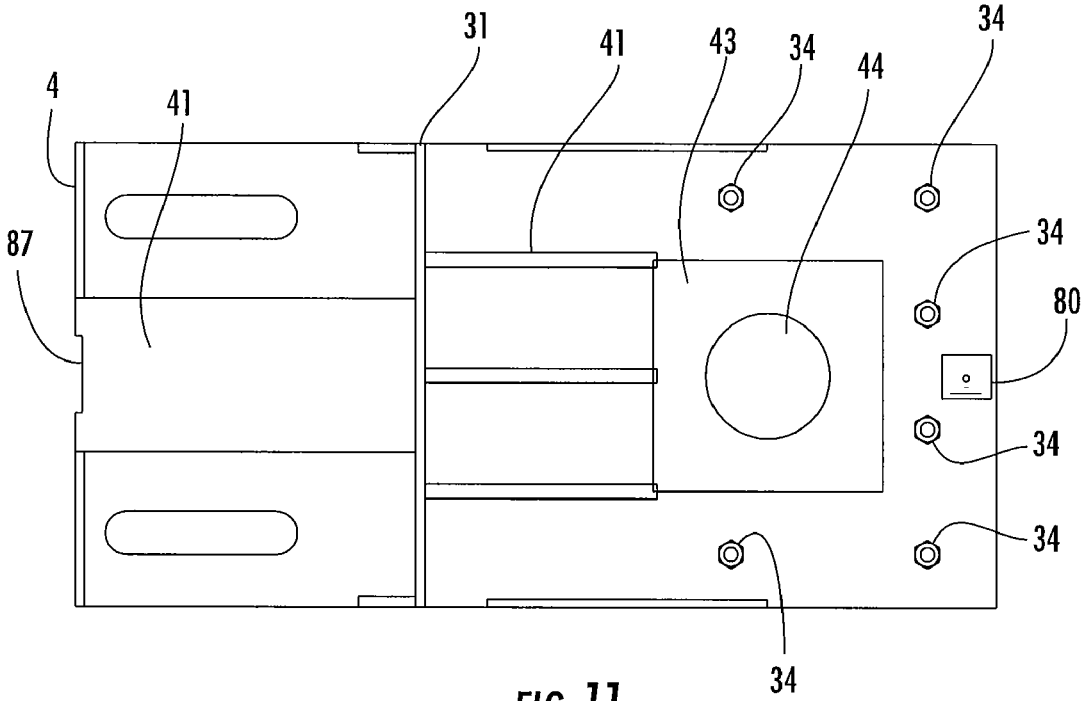
FIG. 11 is a top plan view of a the modular barrier according to the second embodiment configured to receive concrete anchors.

As best illustrated in top plan in FIG. 11, a third embodiment of the portable perimeter defense system 10 of the present invention is also directed to a single barrier 1 or a plurality of modular barriers 1 herein described. According to this embodiment, the front plate 3 includes a single panel, preferably similar to the rear panel 32 described above. This alters the ballistic protection afforded by the barrier according to this embodiment, but which nonetheless offer protection from ballistics capable of stopping small arms or "street-type weapons". The plate according to this embodiment is preferably formed of a 50 grade, ASTM572 steel. Tests have indicated that the ballistic resistance of this embodiment meets or exceed the following standards: NIJ (National Institute of Justice) Level III-A, Part 1; UL-752 (Underwriters Laboratory) Level 3 Part3; and ASTM Level .44 Magnum Alternatively, the front plate could be formed of a harder grade steel such as the armor plated steel described above regarding the front panel. A portable perimeter defense system 10 utilizing a modular barrier 1 according to this embodiment would utilize one or a plurality of barriers to barricade or partition a path of travel while simultaneously providing ballistic protection, such as from street munitions. The modular barrier 1 or barriers 1 are transported according to the below described method of installing the portable perimeter defense system 10 and are positioned utilizing one of the transport assemblies 70 (the tow handle assembly 71 and/or the hauler assembly 72). The modular barrier 1 or barriers 1 include a base plate 2 which, optionally, includes apertures 34 for receiving concrete anchors 22. The base plate may be provided without apertures and may be shorter in length (measured along the impact direction) than the base plate of the modular barriers according to the previously discussed embodiments. Concrete anchors 22 may be rapidly installed using a high strength steel disc that fits into the base plate hole 44 and the barrier 1 is secured to concrete ground surfaces using a 9" Simpson type screw, for example. A rotary hammer is preferably available for installation of the concrete anchor 22. While a preferred embodiment is illustrated, it is within the scope of this invention that earth anchors may alternatively or conjunctively be used and that the apertures 34 may be positioned in any configuration (or not at all).

Figure 19:
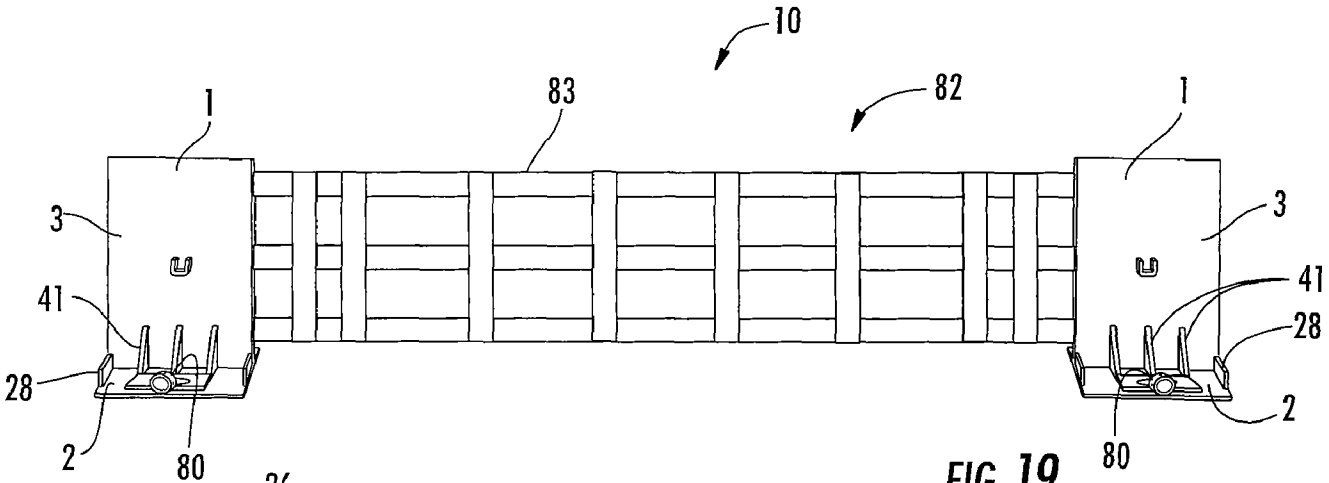
FIG. 19 is a perspective view of a fourth embodiment of the present invention.
Figure 20:
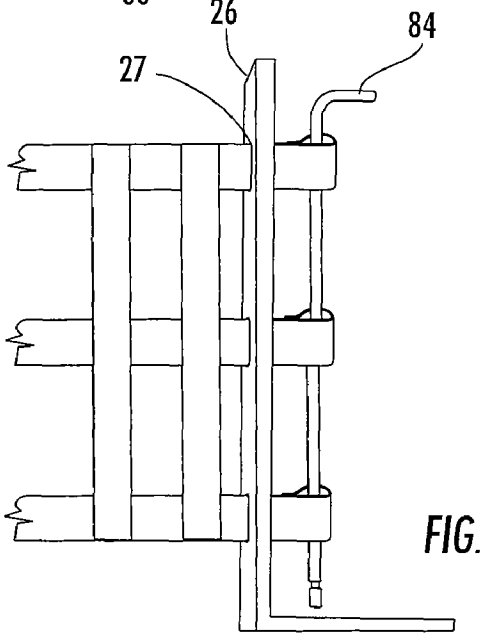
FIG. 20 is a detail view showing the connection of the gate assembly to the modular barrier.

A fourth embodiment of the present invention, shown in FIGS. 19 and 20, is directed to a portable perimeter defense system 10 used for relatively non-threatening environments such as for traffic or pedestrian control. The invention includes at least two, and more if desired, barriers 1 which are preferably configured with a single front plate, i.e., rear plate 32 described above. Although, a modular barrier with the front plate 3 described above is lighter and, therefore preferred in these circumstances, a modular barrier 1 having a two layered front plate with a decelerating zone there between may also be utilized. The modular barriers 1 are juxtapositioned as illustrated in FIG. 19 and gate assembly 82 extends there between. As illustrated, the gate assembly 82 includes a gate in the form of a flexible member 83, such as a net 83. The flexible member 83 preferably is formed of polyester webbing such that it can withstand a load bearing weight of 12,000 lbs. The flexible member may be of any predetermined length or may be adjustable in length. The net 83 may be joined to the modular barriers 1 by positioning lateral edges through the bolt holes 27 of the side plate 26. A steel rod 84 is then positioned through portions of the net 83 extending through the bolt holes 29. This enables the portable perimeter defense system 10 to be rapidly positioned and the net 83 engaged. This embodiment demonstrates the flexibility of the portable perimeter defense system 10 as to its applications in various environments and even changing environment. That is, a barrier 1 according to the third embodiment may also be utilized in the portable perimeter defense system 10 according the fourth embodiment. Similarly, a pair (or more) of the modular barriers 1 according to the first and second embodiments may also be used as a component of the portable perimeter defense system 10 according to the third or fourth embodiments, even if the degree of ballistic resistance is extraneous.

Figure 21:
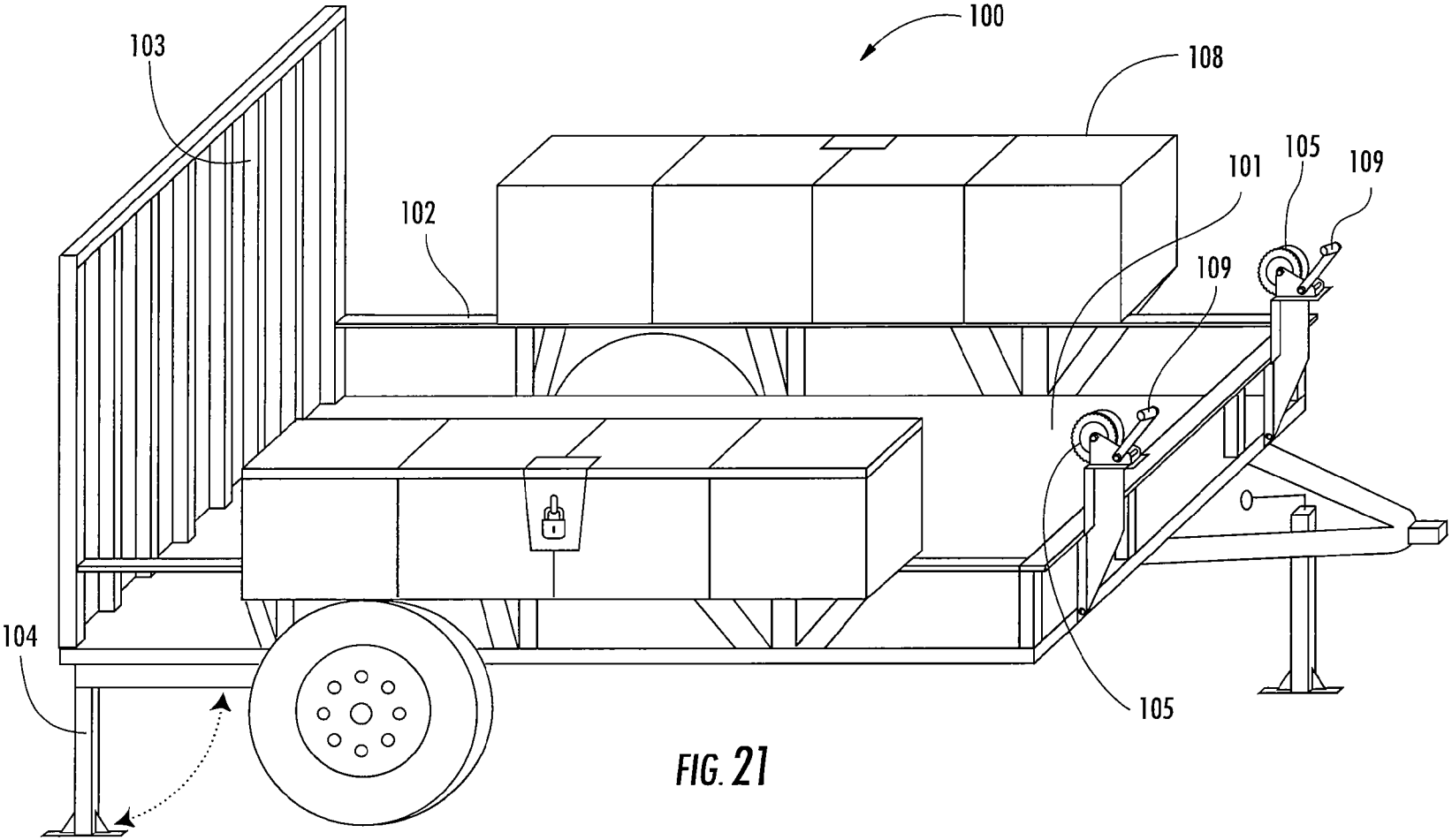
FIG. 21 is a perspective view of a trailer assembly for transporting a plurality of modular barriers.

The portable perimeter defense system 10 also includes a trailer 100, shown in FIG. 21, for transporting one or several modular barriers 1 significant distances. Trailer 100 includes platform base 101, side rails 102 and optional toolboxes 108. Trailer 100 also includes at least one and, preferably, a pair or more of winches 105 (such as are referred to as Fulton Winches). Winches 105 include a crank handle 109 and a web which, according to FIG. 21, is shown rolled up within winches 105 (an therefore not visible) so as to connect to the barriers 1. Ramp 103 is preferably reinforced to support the weight of the modular barriers. Stabilizing jacks 104 are provided to support the aft end of the trailer 100. As illustrated by the phantom directional line in FIG. 21, the stabilizing jack 104 is moveable from an engaged to an disengaged position. Accordingly, a modular barrier is transported to the ramp 103 by one of the transporting assemblies 70; the web of one winch 105 is secured to the modular barrier, such as by being clipped to handle 23; and the winch is actuated via hand crank 109 to pull the modular barrier 1 up the ramp 103 and onto the platform base 101. The modular barrier is removed from the trailer by attaching the web to the barrier by handle 23 and engaging one of the transporting assemblies 70, such as the hauler assembly 72, to the modular barrier 1. Winch 105 is actuated by rotating the hand crank 109 (in reverse direction) and the barrier may be guided off the base 101 and down the ramp 103 to the ground surface by the transporting assembly. The modular barrier 1 may then be further transported to the desired position using one of the transporting assemblies 70.

The method of installing the portable perimeter defense system according to the present invention includes the general steps of transporting the portable perimeter defense system 10 comprising a single barrier or a plurality of barriers to the general vicinity by a trailer, removing the portable defense system 10 from the trailer 100, and relocating the individual modular barrier 1 or barriers 1 to the desired position by forward moving forces. These forward moving forces include moving the modular barriers or barrier utilizing wheels 62 so as to traverse the ground to the desired location. This is achieved utilizing a hauler assembly 72 or tow handle assembly 71, alone or in combination if so preferred.

More specifically, the method of installing the portable perimeter defense system 10 includes the steps of positioning an individual barrier 1 or more than one barrier 1. Individual barriers 1 are positioned by engaging the wheels 62 in the engaged position. As shown in FIGS. 5 and 12, this is achieved by using a crow bar (not shown) which is positioned beneath the curved aft edge 4 of the base plate 2. An indentation 87 along the aft edge (such as is shown in FIG. 11) may be provided to position the crow bar. The crow bar lifts the aft edge 4 off the ground so that the wheels 62 may be fully engaged to cooperate with the ground surface 9. Pins 65 are then positioned within respective pinholes 64 to secure the wheels 62 in the engaged position. To disengage the wheels, pins 65 are removed, and the wheel attachments 60 are pivoted to the disengaged position shown in phantom in FIG. 12. Pins 65 are then inserted into the uppermost pin holes 64 to secure the wheels 62 in an disengaged position.

When the hauler assembly 72 is utilized, the nose 98 engages with the correspondingly configured hauler interface 80 and a pin is inserted into pin holes 86 and 87 to secure the engagement. Hand crank 95 is actuated so as to activate the jack housed within member 94 to raise the front end of the modular barrier 1. This shifts the weight of the barrier 1 onto the wheels 25. The hauler assembly 72 may then be transported with the handle 97 to move the hauler assembly 72 and modular barrier 1 simultaneously. Once positioned, the hauler assembly 72 is removed by removing the pin from the hauler interface 80 and disengaging the nose 90 and hauler interface 80.

Figure 15:
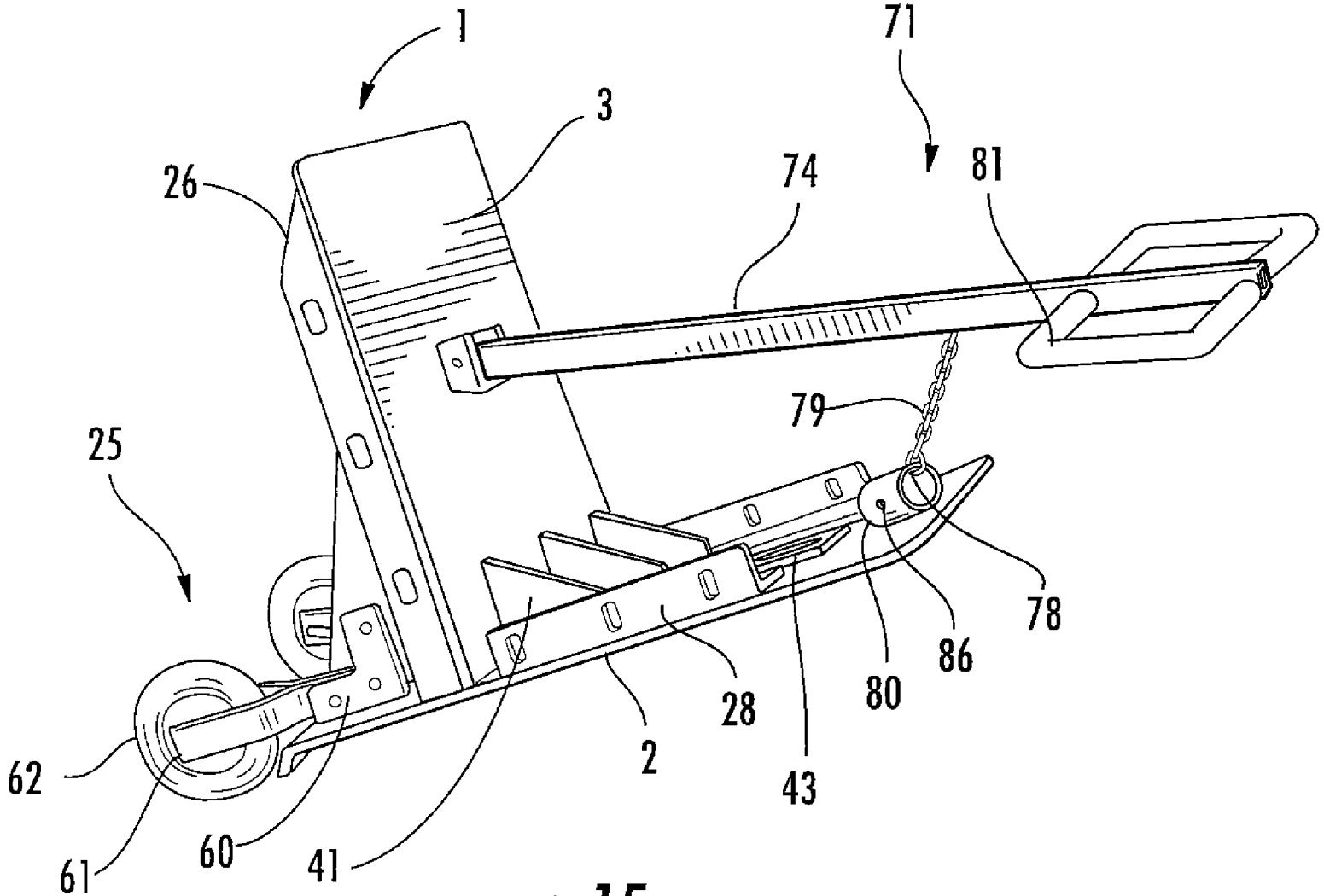
FIG. 15 is a perspective view of the modular barrier being transported with the tow handle assembly.

When the tow bar assembly 71 is utilized, as shown in FIGS. 13-15, the tow bar 74 is engaged with the tow interface 73. Pin 77 is inserted into pinhole 76 as shown in FIG. 13 to secure the engagement. Chain 79 is connected at one end to interface 80 through hole 78 and at its other end to the tow bar 74. The user may then lift the front edge of the modular barrier 1 with the use of handle bar 81 and transport the modular barrier as shown in FIG. 15 to transport the barrier so as to traverse the ground surface. The tow bar assembly 71 and hauler assembly 71 may be used independent of one another or, alternatively, both may be used when positioning individual barriers.

The method of installing the defense system according to the first embodiment of the present invention includes assembling the front 11 and aft 12 rows of barriers. The method of installing a preferred configuration shown in FIG. 2 includes forming one row of barriers (aft or front row first); joining adjacent barriers along the sides of the front plates 3 and base plates 2 utilizing side plates 26 and 28, respectively; and securing the bolts. Anchors suitable for the ground surface may then be installed. The barriers of the second row are then positioned so that the braces 18 of the bracing system 5 are received within a respective rear interface 17 between adjacent resistance bodies 14. The bracing system thereby renders the front and aft rows cooperative. Adjacent barriers of the second row are then secured and anchors may be installed.

Figure 18:
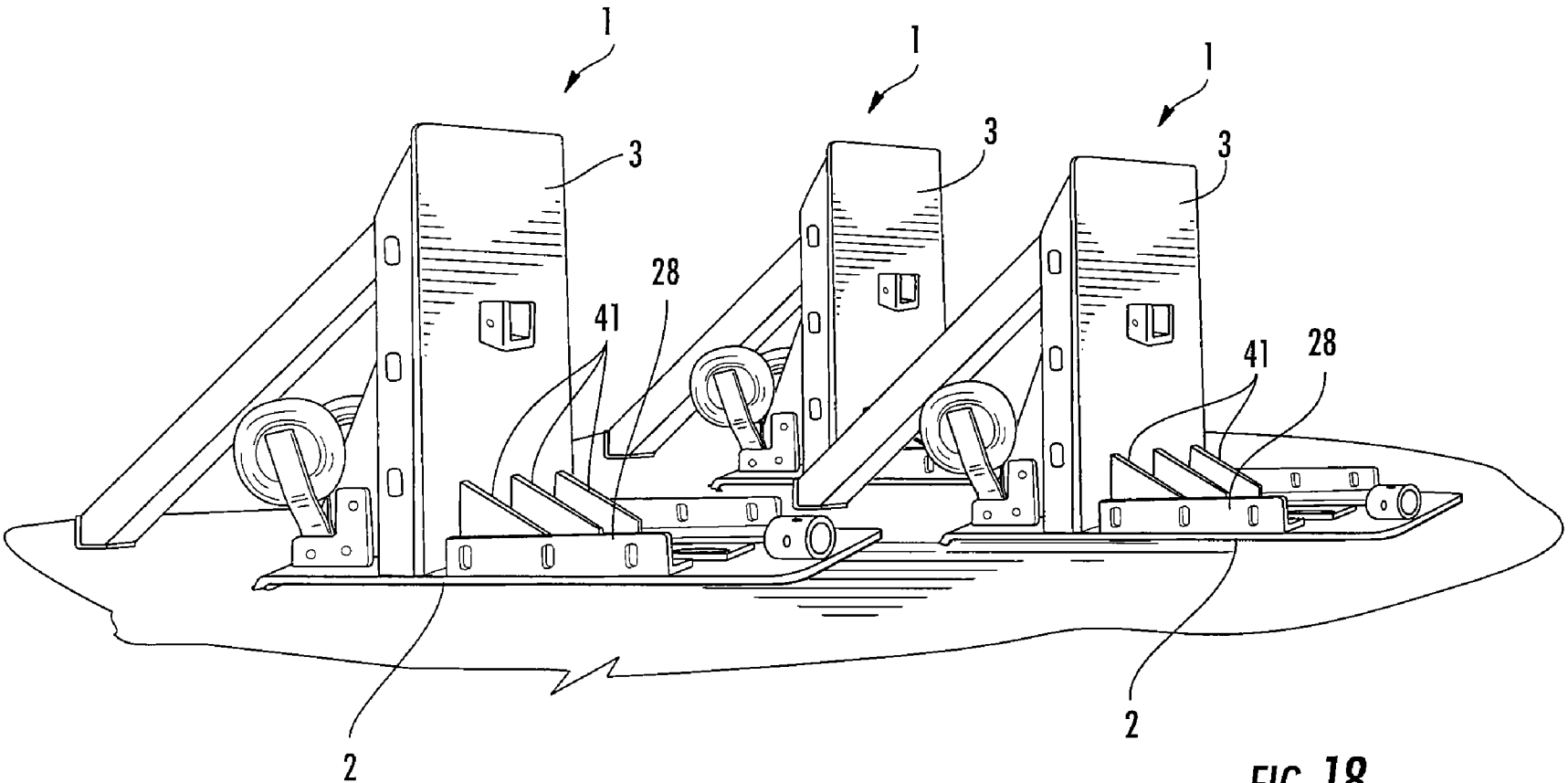
FIG. 18 is a perspective view of an alternate configuration according to the second embodiment of the present invention.

The method of installing a second embodiment of the present invention includes positioning a plurality of modular barriers in a cooperating single row (wherein adjacent barriers are joined) as shown in FIG. 3, a non-cooperating configuration shown in FIG. 18, e.g., staggered, or positioning an individual modular barrier. This method includes the optional step of positioning the bracing system so as to cooperate with the ground surface and optionally securing the end of brace 18 to the ground surface. The method of installing the third embodiment includes the aforementioned steps without utilizing a bracing system. The fourth embodiment includes the additional step of attaching a gate assembly 82 between juxtapositioned modular barriers so as to partition a path of travel as described above.

The foregoing describes some embodiments that implement the concepts of the present invention. The description is for purposes of illustration and not limitation. Modifications of the above embodiments that are within the ordinary skill of the art are fully contemplated and encompassed by the scope of the present invention, which is limited only by the appended claims.

What is claimed is:

1. A portable perimeter defense system for stopping movement of a vehicle in an impact direction, the defense system comprising:

a first modular barrier;

said modular barrier comprising an upright plate being configured to and being formed of a material to protect against munitions, a base plate for positioning on a ground surface wherein said upright plate extends generally perpendicular to said base plate, and means for transporting said first modular barrier; and a brace diagonally extending from the aft side of said upright plate past the base plate, wherein said brace is fixedly secured to said upright plate when said barrier is positioned for preventing aft tilting of the upright plate under a force generated by an object impacting the front plate in the impacting direction.

2. A portable perimeter defense system according to claim 1 further comprising:

a second modular barrier positioned to the rear of the first modular barrier, said second modular barrier including a second upright plate, a material to protect against munitions, a second base plate and a second barrier brace interface affixed to the second base plate, wherein said brace of said first modular barrier has a first and second end and said first modular barrier includes a first brace interface; and wherein the first end of the brace is received by the first brace interface of the first modular barrier and the second end of the brace is received by the second brace interface of the second modular barrier, wherein an impact force against the front plate of the first modular barrier is transferred rearward and downward from the first brace interface through the brace and into the second brace interface of the second modular barrier.

3. A portable perimeter defense system according to claim 2 wherein said second modular barrier includes at least one bracing element abutting the upright plate configured to brace the front panel against an object colliding into the upright plate in the direction of impact.

4. A portable perimeter defense system according to claim 3 wherein said modular barrier includes at least two bracing elements and wherein said at least two bracing elements and said base plate, adjacent said upright plate, define said second brace interface for receiving said second end of said brace.

5. A portable perimeter defense system according to claim 4 wherein said barrier includes at least three bracing elements for defining a plurality of said second brace interfaces.

6. A portable perimeter defense system according to claim 1 wherein said modular barrier further comprises an elongate anchor engaging a front end of the base plate facing against the impact direction extending into and engaged by the ground to oppose forces tending to move the base plate relative to the ground surface.

7. A portable perimeter defense system according to claim 6 wherein said base plate of said modular barrier further comprises an aperture and said anchor extends through the aperture, said anchor including a first member proximate an end of the anchor for engaging an upwardly facing surface of the base plate, and an augur tip proximate another end of the anchor for securing the anchor and the base plate to the ground by rotating the anchor while advancing it into the ground.

8. A portable perimeter defense system according to claim 7 wherein said anchor further includes at least one fin extending outwardly from said anchor adjacent said first member for engaging said aperture of the base plate so as to cooperate with said first member for securing the anchor and the base plate to the ground.

9. A portable perimeter defense system according to claim 1 wherein said brace of said modular barrier cooperates with the ground surface to prevent aft tilting of the barrier upon impact.

10. A portable perimeter defense system according to claim 9 wherein said brace is secured to the ground surface.

11. A portable perimeter defense system according to claim 1 further comprising:

a second modular barrier positioned adjacent to a side of said first modular barrier having a second upright plate and a second base plate for positioning on a ground surface wherein said second upright plate extends generally perpendicular to said second base plate so as to form a continuous line of barriers wherein said first and second modular barriers are attached along sides thereof to form a first row of barriers.

12. A portable perimeter defense system according to claim 11 wherein said first and second upright plates include side plates for securing said first and second modular barriers to one another.

13. A portable perimeter defense system according to claim 1 wherein said defense system further comprises a bracing support for receiving said brace of said modular barrier wherein said bracing support is defined by a structure separate of said base plate wherein said bracing support is secured to said ground surface.

14. A portable perimeter defense system according to claim 11 further comprising a third barrier for forming a substantially parallel second row behind said first row of barriers wherein said brace renders the first and second rows of barriers cooperative so that the second row absorbs impact forces and prevents potential movement of the first barrier in a horizontal direction under forces from the impacting vehicle.

15. A portable perimeter defense system according to claim 14 wherein said second row of barriers comprises at least two modular barriers secured to one another along common sides thereof.

16. A portable perimeter defense system according to claim 15 wherein said first row of barriers comprises seven modular barriers each having side plates to secure adjacent barriers and said second row of barriers comprises five modular barriers each having at least one side plate for securing adjacent barriers.

17. A portable perimeter defense system according to claim 1 further comprising:

a second modular barrier positioned remotely from said first modular barrier having a second upright plate and a second base plate for positioning on a ground surface wherein said second upright plate extends generally perpendicular to said second base plate so as to form a non-cooperative and unconnected configuration of barriers.

18. A portable perimeter defense system according to claim 1 wherein said first modular barrier further comprises a bracing element adjacent an aft side of said upright plate adjacent the base plate for supporting said upright panel upon impact.

19. A portable perimeter defense system according to claim 18 wherein said bracing element extends from said base plate toward said upright plate and extends across about ⅓ the width of said upright plate.

20. A portable perimeter defense system according to claim 1 further comprising a ballistic plate extension removably connected to an upper area of said upright panel for vertically extending said upright panel and providing additional protection against munitions.

21. A portable perimeter defense system for stopping movement of a vehicle in an impact direction, the defense system comprising:

a first modular barrier;

said modular barrier comprising an upright plate being configured to and being formed of a material to protect against munitions and a base plate for positioning on a ground surface wherein said base plate extends generally parallel to the ground surface and said upright plate extends generally perpendicular to said base plate;

said base plate of said modular barrier comprising a non-planar aft edge configured to frictionally engage the ground surface to prevent horizontal movement of said modular barrier upon impact, said non-planar aft edge extending along a portion of the width of said base plate.

22. A portable perimeter defense system according to claim 21 wherein said aft edge is arcuate in configuration so as to define a concave portion facing the ground so as to present an abutting edge for preventing unintentional horizontal movement of said barrier.

23. A portable perimeter defense system according to claim 21 further comprising a brace positioned adjacent said upright plate and supported by said base plate for supporting said upright panel upon impact.

24. A portable perimeter defense system according to claim 21 wherein said aft edge extends substantially along the entire width of said base plate.

25. A portable perimeter defense system for stopping movement of a vehicle in an impact direction and for providing protection from munitions, the defense system comprising:

a first modular barrier;

said modular barrier comprising an upright plate being configured to and being formed of a material to protect against munitions and a base plate for positioning on a ground surface wherein said upright plate extends generally perpendicular to said base plate wherein said upright plate comprises a front panel, an aft panel, and side panels wherein said side panels, front panel and aft panel form a box-like configuration with a decelerating zone defined there between for providing advanced levels of protection from munitions.

26. A portable perimeter defense system according to claim 25 wherein said decelerating zone is between 1 and 3 inches wide.

27. A portable perimeter defense system according to claim 26 wherein said decelerating zone is between 1½ and 2 inches wide.

28. A portable perimeter defense system according to claim 25 wherein said decelerating zone comprises a bullet decelerating material.

29. A portable perimeter defense system according to claim 25 wherein said upright panel further comprises a top panel wherein said side panels, top panel, front panel and aft panel from said box-like configuration.

30. A portable perimeter defense system according to claim 25 wherein said front panel is formed of armor plated steel.

31. A portable perimeter defense system according to claim 30 wherein said armor plated steel performs at NIJ Level IV for stopping munitions.

32. A portable perimeter defense system according to claim 25 wherein said aft panel is formed of a material providing additional protection against munitions.

33. A portable perimeter defense system according to claim 25 further comprising a ballistic plate extension removably connected to an upper area of said upright panel for vertically extending said upright panel and providing additional protection against munitions.

34. A portable perimeter defense system for stopping movement of a vehicle in an impact direction, the defense system comprising:

a first modular barrier;

said modular barrier comprising an upright plate being configured to and being formed of a material to protect against munitions and a base plate for positioning on a ground surface wherein said upright plate extends generally perpendicular to said base plate;

said modular barrier further comprising a wheel assembly connected to said base plate for permitting said modular barrier to be transported by traversing the ground; and said wheel assembly comprising a wheel attachment and a wheel wherein said wheel attachment pivotally secures said wheel to said base plate such that said wheel assembly is attached to said base plate to move from an engaged to a disengaged position.

35. A portable perimeter defense system according to claim 34 wherein said wheel assembly further comprises securing means for securing said wheel in said engaged position.

36. A portable perimeter defense system according to claim 34 wherein said modular barrier comprises at least two of said wheel assemblies.

37. A portable perimeter defense system according to claim 34 wherein said base plate of said modular barrier comprises a non-planar aft edge configured to frictionally engage the ground surface to prevent horizontal movement of said modular barrier when said wheels are in said disengaged position.

38. A portable perimeter defense system according to claim 34 wherein said aft edge is raised off of the ground surface when said wheels are in said engaged position.

39. A portable perimeter defense system according to claim 34 further comprising:

a second modular barrier including a second upright plate being configured to and being formed of a material to protect an area and a second base plate wherein said second upright plate extends generally perpendicular to said second base plate and said first and second modular barriers are positioned with a distance there between wherein an impact side of each modular barrier faces the impact direction; and a gate assembly removably secured to said first and second modular barriers so as to extend across said distance between the barriers.

40. A portable perimeter defense system according to claim 39 wherein said gate assembly is generally flexible and is removably secured to said first and second barriers.

41. A portable perimeter defense system according to claim 40 wherein said first modular barrier includes a side plate positioned along at least one side edge of said upright panel facing a side of said second modular barrier and said second modular barrier includes a side plate positioned along at least one side edge of said upright panel facing a side of said first modular barrier wherein said gate assembly is removably secured to said side plates.

42. A portable perimeter defense system according to claim 34 further comprising:

a first transporting assembly; and said first modular barrier includes a first transporting assembly interface for cooperating with said transporting assembly interface for transporting said modular barrier with said wheel assembly in an engaged position.

43. A portable perimeter defense system according to claim 42 wherein said transporting assembly is a tow handle assembly comprising a tow bar which engages with said first interface for moving said modular barrier so as to traverse the ground surface.

44. A portable perimeter defense system according to claim 43 wherein said first interface is supported on said upright plate on an impact side thereof for receiving the tow bar of said tow handle assembly.

45. A portable perimeter defense system according to claim 44 wherein said base plate of said modular barrier includes a second transporting assembly interface including means for securing said tow bar in an engaged position to transport said modular barrier so as to traverse the ground surface.

46. A portable perimeter defense system according to claim 45 wherein said securing means includes a chain which is connected at one end to said tow bar and at another end to said second interface.

47. A portable perimeter defense system according to claim 42 wherein said transporting assembly is a hauler assembly comprising a mating element which engages with said first interface for moving said modular barrier and said at least one wheel so as transport said modular barrier to traverse the ground surface.

48. A portable perimeter defense system according to claim 47 wherein said hauler assembly comprises:

a handle for manipulating said hauler assembly;

a frame for supporting said handle and said wheel; and a jack member associated with said frame for lifting said mating element to raise a portion of said first modular portion to fully engage the wheel of said modular barrier.

49. A portable perimeter defense system according to claim 48 wherein said jack member is configured for manual manipulation of said hauler assembly.

50. A method of protecting an area from heavy, fast-moving objects approaching in an impact direction comprising the steps of:

utilizing a portable perimeter defense system having at least a first row of modular barriers comprising at least one barrier and a second row of modular barriers comprising at least one barrier wherein each of said barriers comprises an upright plate providing protection from munitions and a base plate for positioning said barrier on a ground surface, said upright plates extending generally perpendicular to said base plates, and providing a bracing system having a brace associated with the upright plate of said at least one barrier of said first row;

positioning said first row of modular barriers so as to define a perimeter for the protected area wherein an impact side of said at least one barrier faces the impact direction;

positioning said second row of modular barriers behind and substantially parallel to said first row of barriers wherein an impact side of at least one barrier faces the impact direction; and bracing said first row against said second row with said bracing system; and transferring impact forces against the front plate of the first modular barrier rearwardly and downwardly from the first row barrier through the brace and into said at least one second modular barrier of the second row.

51. A method according to claim 50 further comprising the step of:

anchoring said at least one modular barrier of said first row into a substrate by drilling the anchor into a substrate using an augur tip disposed at a first end of the anchor such that a second end of the anchor abuts against a top of the base plate; and leaving the anchor in place in the substrate to secure the barrier to the substrate.

52. A method according to claim 50 further comprising the steps of:

positioning seven modular barriers in said first row of barriers;

positioning five modular barriers in said second row of barriers; and bracing said barriers of said first row with braces of said bracing systems against said barriers of said second row.

53. A method according to claim 50 further comprising the step of protecting said area with said portable perimeter defense system so as to meet National Institute of Justice Level IV protection against munitions.

54. A method of installing a portable perimeter defense system including a first modular barrier comprising an upright plate being configured to and being formed of a material to protect an area and a base plate for positioning on a ground surface wherein said upright plate extends generally perpendicular to said base plate for stopping movement of a vehicle in an impact direction and a wheel assembly which supports said barrier in an engaged position, comprising the steps of:

transporting said first modular barrier supported by said wheel assembly to the perimeter of said area with a transporting assembly such that said barrier traverses the ground with said wheel assembly in the engaged position;

positioning said modular barrier with said transporting assembly;

disengaging said transporting assembly; and disengaging said wheel assembly.

55. A method according to claim 54 further comprising the step of securing said modular barrier by frictionally engaging the ground surface with a non-planar aft edge of said barrier to prevent horizontal movement of said modular barrier.

56. A method according to claim 54 further comprising the steps of:

transporting a second modular barrier supported by a second wheel assembly to the perimeter of said area with said transporting assembly such that said barrier traverses the ground with said wheel assembly in the engaged position;

positioning said second modular barrier with said transporting assembly adjacent said first barrier;

disengaging said transporting assembly;

disengaging said second wheel assembly; and connecting said adjacent barriers.

57. A method according to claim 54 further comprising the steps of:

transporting a second modular barrier supported by a second wheel assembly to the perimeter of said area with said transporting assembly such that said barrier traverses the ground with said wheel assembly in the engaged position;

positioning said second modular barrier with said transporting assembly juxtapositioned from said first barrier; and disengaging said transporting assembly;

disengaging said second wheel assembly; and extending a gated assembly between said first and second barriers.

58. A portable perimeter defense system for stopping movement of a vehicle in an impact direction and for providing protection to an area, the defense system comprising:

a first modular barrier;

said modular barrier comprising an upright plate being configured to and being formed of a material to protect against munitions and a base plate for positioning on a ground surface wherein said upright plate extends generally perpendicular to said base plate;

a brace diagonally extending from the aft side of the upright plate of said first modular barrier and extending past the base plate, said brace having a first and second end;

a second modular barrier positioned to the rear of the first modular barrier, said second modular barrier including a second upright plate, a second base plate and a second barrier brace interface affixed to the second base plate; and wherein the first end of the brace extends from the aft side of the upright plate of the first modular barrier and the second end of the brace is received by the brace interface of the second modular barrier, wherein an impact force against the front plate of the first modular barrier is transferred rearward and downward through the brace and into the second modular barrier.

59. A portable perimeter defense system according to claim 58 wherein said second modular barrier further comprises an elongate anchor engaging a front end of the base plate facing against the impact direction extending into and engaged by the ground to oppose forces tending to move the ground plate relative to the ground surface.

60. A portable perimeter defense system according to claim 59 wherein said base plate of said second modular barrier further comprises an aperture for receiving said anchor which extends through the aperture, said anchor including a first member proximate an end of the anchor for engaging an upwardly facing surface of the base plate, and an augur tip proximate another end of the anchor for securing the anchor and the base plate to the ground by rotating the anchor while advancing it into the ground.

61. A portable perimeter defense system according to claim 60 wherein said anchor further includes at least one fin adjacent said first member for engaging the base plate so as to cooperate with said first member for securing the anchor and the base plate to the ground.

62. A portable perimeter defense system according to claim 58 wherein said second modular barrier includes at least one bracing element abutting the upright plate configured to brace the front panel against an object colliding into the upright plate in the direction of impact.

63. A portable perimeter defense system according to claim 62 wherein said second modular barrier includes at least two bracing elements and wherein said at least two bracing elements and said base plate, adjacent said upright plate, define said brace interface of said second barrier for receiving said second end of said brace extending from said first modular barrier.

64. A portable perimeter defense system according to claim 63 wherein said second modular barrier includes at least three bracing elements for defining a plurality of said brace interfaces.

65. A portable perimeter defense system for stopping movement of a vehicle in an impact direction and for providing protection to an area, the defense system comprising:

a first modular barrier;

said modular barrier comprising an upright plate being configured to and being formed of a material to protect against munitions and a base plate for positioning on a ground surface wherein said upright plate extends generally perpendicular to said base plate, said base plate defining an aperture;

said modular barrier further comprising an elongate anchor for positioning in said base plate aperture extending into and engaged by the ground to oppose forces tending to move the base plate relative to the ground surface, said anchor including a first member proximate an upper end of the anchor for engaging an upwardly facing surface of the base plate and a fin proximate said first member and extending outwardly from said anchor for engaging said aperture of said base plate, and an augur tip proximate another end of the anchor for securing the anchor and the base plate to the ground by rotating the anchor while advancing it into the ground.

66. A portable perimeter defense system according to claim 65 wherein said auger tip is helical.

67. A portable perimeter defense system according to claim 65 wherein said anchor has a length greater than the length of the base plate measured between fore and aft edges thereof.

* * * * *